US006581700B2

(12) United States Patent
Curlett et al.

(10) Patent No.: US 6,581,700 B2
(45) Date of Patent: Jun. 24, 2003

(54) FORMATION CUTTING METHOD AND SYSTEM

(75) Inventors: Harry B. Curlett, Park County, WY (US); David Paul Sharp, Houston, TX (US); Marvin Allen Gregory, Spring, TX (US)

(73) Assignee: Curlett Family Ltd Partnership, Cody, WY (US)

( * ) Notice: Subject to any disclaimer, the term of this patent is extended or adjusted under 35 U.S.C. 154(b) by 0 days.

(21) Appl. No.: 10/097,038

(22) Filed: Mar. 12, 2002

(65) Prior Publication Data

US 2002/0100615 A1 Aug. 1, 2002

Related U.S. Application Data

(63) Continuation of application No. 09/665,586, filed on Sep. 19, 2000, now Pat. No. 6,386,300.

(51) Int. Cl.[7] ..... E21B 7/16

(52) U.S. Cl. ..... 175/65; 175/67; 175/424

(58) Field of Search ..... 175/57, 65, 67, 175/66, 207, 217, 340, 424

(56) References Cited

U.S. PATENT DOCUMENTS

| | | | |
|---|---|---|---|
| 3,112,800 | A | 12/1963 | Bobo |
| 3,576,221 | A | 4/1971 | Asiba |
| 3,865,202 | A | 2/1975 | Takahashi et al. |
| 4,042,048 | A | 8/1977 | Schwabe |
| 4,624,327 | A | 11/1986 | Reichman |
| 5,862,871 | A | 1/1999 | Curlett |
| 5,944,123 | A | 8/1999 | Johnson |

OTHER PUBLICATIONS

Arthur Anderson, global E&P Trends, Jul. 1999, p. 13.
Mike Killalea: "High Pressure Drilling System Triples ROPS, Stymies Bit Wear," pp. 10 and 12.
Security DBS Booklet.
S. D. Venhuizen et al: "Ultra–High Pressure jet Assist of Mechanical Drilling," SPE/IADC 37579 The Nederlands, Mar. 4–6, pp. 79–90.

(List continued on next page.)

*Primary Examiner*—Frank Tsay
(74) *Attorney, Agent, or Firm*—Loren G. Helmreich; Browning Bushman P.C.

(57) ABSTRACT

A method and system for drilling or cutting a subterranean well or formation 52 using a drilling rig 5, a drill string 55, a plurality of solid material impactors 100, a drilling fluid and a drill bit 60 is disclosed. This invention may have particular utility in drilling wells for the petroleum industry and for cutting formation in the mining and tunnel boring industries. In a preferred embodiment, a plurality of solid material impactors are introduced into the drilling fluid and pumped through the drill string and drill bit to impact the formation ahead of the bit. At the point of impact, a substantial portion by weight of the impactors may have sufficient energy to structurally alter, excavate, and/or fracture the impacted formation. The majority by weight of the plurality of solid material impactors may have a mean diameter of at least 0.100 inches, and may structurally alter the formation to a depth of at least twice the mean diameter of the particles comprising the impacted formation. Impactor mass and/or velocity may be selected to satisfy a mass-velocity relationship in the respective impactor sufficient to structurally alter the formation. Rotational, gravitational, kinetic and/or hydraulic energy available at the bit in each of the bit, the impactors and the fluid may thereby more efficiently effect the generation and removal of formation cuttings ahead of the bit.

96 Claims, 4 Drawing Sheets

OTHER PUBLICATIONS

William C. Maurer and John S. rinehart: "Impact Crater formation in Rock," Journal of applied Physics, vol. 31, No. 7, Jul., 1960.

A New Look at Bit Flushing or The Importance of the Crushed Zone in Rock Drilling and Cutting [undated], by Carl R. Peterson, Dept. of Mechanical Engineering, Massachusetts Institute of Technology; Michael Hood, Dept. Materials Science and Mineral Engineering, University of Californiat at Berkeley.

A Reveiw of Mechanical Bit/Rock Interactions, [undated], vol. 3, pp. 3–1 to 3–68.

Waterjetting Technoloyg {Undated], David A. Summners.

Advanced Drilling Techniques, William C. Maurer, 1963.

Rock Breakage By Pellet Impace, by Madan M. Singh for the Dept. of Transportation, Ofc. of High Speed Ground Transportation, IITRI, Project No. D6000, Final Report No. D6000–10, Contract No. DOT3–0171, Dec. 24, 1969.

A Study of Fragmentation of Rock by Impingement with Water and Solid Impactors, Minnesota, University of Minneapolis, U.S. Department of Commerce, Feb. 1972.

Development of High–Pressure Abrasice–Jet Drilling, by John C. Fair, SPE, Gulf Research and Development Co., Journal of Petroleum Technology, May 1981.

Deep Drilling Basic Research, vol. 1—Summary Report, Maurer Engineering Inc., University of California at Berkeley, Final Report Nov., 1988–Aug., 1990.

A Further Investigation of DIA Jet Cutting, by D. A. Summers; J. Yao and W–Z Wu, Universtiy of Missouri, Rolla, USA, 1991, Chapter. 11.

Laboratory and Field Testing of an Ultra–High Pressure, Jet–Assisted Drilling System by J. J. Kolle, QUEST Integrated, Inc., and R. Otta and D. L. Stang, FlowDril Corp., SPE/IADC 2200, 1991.

FORMATION CUTTING METHOD AND SYSTEM

RELATED APPLICATION

The present application is a continuation of U.S. Ser. No. 09/665,586 filed on Sep. 19, 2000 now U.S. Pat. No. 6,386,300.

FIELD OF THE INVENTION

This invention is generally applicable to cutting earthen or subterranean formations. More particularly, this invention is applicable to drilling wells such as oil, gas or geothermal wells. Additionally, this invention may be used in drilling and mining wherein tunnels, pipe chases, foundation piers, holes or other penetrations or excavations are made through formations for purposes other than production of hydrocarbons or geothermal energy.

BACKGROUND OF THE INVENTION

The process of drilling a well bore or cutting a formation to construct a tunnel and other subterranean earthen excavations is a very interdependent process that preferably integrates and considers many variables to ensure a usable bore is constructed. As is commonly known in the art, many variables have an interactive and cumulative effect of increasing drilling costs. These variables may include formation hardness, abrasiveness, pore pressures and formation elastic properties. In drilling wellbores, formation hardness and a corresponding degree of drilling difficulty may increase exponentially as a function of increasing depth. A high percentage of the costs to drill a well are derived from interdependent operations that are time sensitive, i.e., the longer it takes to penetrate the formation being drilled, the more it costs. One of the most important factors affecting the cost of drilling a well bore is the rate at which the formation can be penetrated by the drill bit, which typically decreases with harder and tougher formation materials and formation depth. Consequently, drilling costs typically tend to increase exponentially with depth.

There have been many substantially varied efforts to meaningfully increase the effective rate of penetration ("ROP") during the drilling process and to thereby reduce the cost of drilling or cutting formations by improving drill bit efficiency. Dr. William C. Maurer's book entitled, "Advanced Drilling Techniques" published by Petroleum Publishing Company in 1980 outlines several novel efforts in an attempt to address the issue of increasing the rate of penetration. Further, Dr. Maurer's book illustrates the tremendous interest, breadth of participation and significant money spent attempting to fulfill the long-felt need for substantially improving the ROP.

Three significant efforts of a sustained nature to meaningfully increase ROPs warrant discussion relating to this invention. The first two of these efforts involved high-pressure circulation of a drilling fluid as a foundation for potentially increasing the rate of penetration. It is common knowledge that hydraulic power available at the rig site vastly outweighs the power available to be employed mechanically at the drill bit. For example, modem drilling rigs capable of drilling a deep well typically have in excess of 3000 hydraulic horsepower available and can have in excess of 6000 hydraulic horsepower available while less than one-tenth of that hydraulic horsepower may be available at the drill bit. Mechanically, there may be less than 100 horsepower available at the bit/rock interface with which to mechanically drill the formation.

One of the first significant efforts at increasing rates of penetration was a promising attempt to directly harness and effectively utilize hydraulic horsepower at the drill bit by incorporating entrained abrasives in conjunction with high pressure drilling fluid ("mud"). This resulted in an abrasive laden, high velocity jet assisted drilling process. The most comprehensive work conducted in attempting to use drilling fluid entrained abrasives was conducted by Gulf Research and Development Company. This work is described in detail in a number of published articles and is the subject of many issued patents. This body of work teaches the use of abrasive laden jet streams to cut concentric grooves in the bottom of the hole leaving concentric ridges that are then broken by the mechanical contact of the drill bit. There was ample demonstration that the use of entrained abrasives in conjunction with high drilling fluid pressures caused accelerated erosion of surface equipment and an inability to control drilling mud density, among other issues. Generally, the use of entrained abrasives was considered practically and economically unfeasible. This work was summarized in the last published article titled "Development of High Pressure Abrasive-Jet Drilling," authored by John C. Fair, Gulf Research and Development. It was published in the Journal of Petroleum Technology in the May 1981 issue, pages 1379 to 1388. Due to this discouraging terminal report, the industry has not meaningfully attempted to further investigate and develop a system to use abrasives for well bore drilling purposes.

A second significant effort to directly harness and effectively utilize the hydraulic horsepower available at the bit incorporated the use of ultra-high pressure jet assisted drilling. A group known as FlowDril Corporation was formed to develop an ultra-high-pressure liquid jet drilling system in an attempt to significantly increase the rate of penetration. FlowDril spent large sums of money attempting to commercially field a drilling system. The work was based upon U.S. Pat. No. 4,624,327 and is well documented in the published article titled "Laboratory and Field testing of an Ultra-High Pressure, Jet-Assisted Drilling System" authored by J. J. Kolle, Quest Integrated Inc., and R. Otta and D. L. Stang, FlowDril Corporation; published by SPE/IADC Drilling Conference publications paper number 22000. Further to the cited publication, it is common knowledge that the complications of pumping and delivering ultra-high-pressure fluid from surface pumping equipment to the drill bit proved both operationally and economically unfeasible. FlowDril Corporation is continuing development of an "Ultra-High Pressure Down Hole Intensifier" as a substitute technology in an effort to commercialize its product. Of note is the fact that FlowDril demonstrated that generating a kerf near the hole gage will produce increased efficiencies for the mechanical action of the drill bit. This is cited in the conclusions stated in the article titled "Ultra-High Pressure Jet Assist of Mechanical Drilling" authored by S. D. Veehuizen, FlowDril Corp; J. J. Kolle, Hydropulse L. L. C.; and C. C. Rice and T. A. O'Hanlon, FlowDril Corp. published by SPE/IADC Drilling Conference publications, paper 37579.

A third significant effort at increasing rates of penetration by taking advantage of hydraulic horsepower available at the bit was developed by the inventor who was issued U.S. Pat. No. 5,862,871 for the process. This development employed the use of a specialized nozzle to excite normally pressured drilling mud at the drill bit. The purpose of this nozzle system was to develop local pressure fluctuations and a high speed, dual jet form of hydraulic jet streams to more effectively scavenge and clean both the drill bit and the formation being drilled. It is believed that these novel hydraulic jets were able to penetrate the fracture plane generated by the mechanical action of the drill bit in a much more effective manner than conventional jet were able to do. Rate of penetration increases from 50% to 400% were field demonstrated and documented in the field reports titled "DualJet Nozzle Field Test Report—Security DBS/Swift Energy Company," and "DualJet Nozzle Equipped M-1LRG Drill Bit Run". The ability of the dual jet ("DualJet") nozzle system to enhance the effectiveness of the drill bit action to increase the effective rate of penetration required that the drill bits first initiate formation indentations, fractures, or both. These features could then be exploited by the hydraulic action of the DualJet nozzle system.

Due at least partially to the effects of overburden pressure, formations at deeper depths may be inherently tougher to drill due to changes in formation pressures and rock properties, including hardness and abrasiveness. Associated in-situ forces, rock properties and increased drilling fluid density effects may set up a threshold point at which the drill bit drilling mechanics changes from formation fracture inception to a work hardening effect upon the formation. Generated by indentation mechanics upon more plastic rocks such as typically found at deeper depths, the work hardening effects may cause flaking failure of the drilled formation surface by the drill bit, as opposed to fracture inception. Repeated compacting of the formation by the drill bit teeth may toughen the plastic-like formation encountered at deeper depths. The effectiveness of the DualJet nozzle system in increasing rate of penetration in these toughened, more plastic formations was reduced due to a reduction in the generation of fractures and chip-like cuttings. Under these tougher drilling conditions, the process of chip generation was solely the function of the mechanical action of the drill bit, resulting in reduced rate of penetration. If the mechanical action of the drill bit could no longer incipiate formation fractures under these conditions, it became obvious that a hydraulic assist technology, which was thereby unable to effectively cut the formation, would be of little assistance.

Another significant factor adversely effecting rate of penetration in formation drilling, especially in plastic type rock drilling, such as shales, is a build-up of hydraulically isolated crushed rock material on the surface being drilled. This occurrence is predominantly a result of repeated impacting and recompacting of previously drilled particulate material on the bottom of the hole by the bit teeth, thereby forming a false bottom under the repeated impacting of the drill bit teeth. The substantially continuous process of drilling, recompacting, removing, re-depositing and recompacting and drilling new material may significantly adversely effect drill bit efficiency and rate of penetration. The recompacted material is at least partially removed by mechanical displacement due to the cone skew of the roller cone type drill bit and partially removed by hydraulics, again emphasizing the importance of good hydraulic action and hydraulic horsepower at the bit. For hard rock bits, build-up removal by cone skew is typically reduced to near zero, which may make build-up removal substantially a function of hydraulics.

The history of attempts to increase the rate of penetration as the well bore deepens illustrates a fundamental problem. This problem has been the inability to employ a means to generate formation fractures or formation disintegration under in-situ conditions at depth. There are no modem processes or practices currently available to the drilling industry that can drill at relatively high rates of penetration under "at depth" conditions. Therefore, there is a high demand for a drilling system capable of commercially drilling well bores at high rates of penetration in deep or tough formations.

There have been many efforts to increase ROP by improving the mechanical and the hydraulic actions of the drill bit. When a drill bit cuts rock or formation, several actions effecting rate of penetration and bit efficiency may be occurring. The bit teeth may be cutting, milling, pulverizing, scraping, shearing, sliding over, indenting and fracturing the formation the bit is encountering. The desired result is that formation cuttings or chips are generated and circulated to the surface by the drilling fluid. Other factors may also effect rate of penetration, including formation structural or rock properties, pore pressure, temperature and drilling fluid density may also adversely effect rates of penetration.

There are generally two categories of modern drill bits that have evolved from over a hundred years of development and untold amounts of dollars spent on the research, testing and iterative development. These are the commonly known fixed cutter drill bit and the roller cone drill bit. Within these two primary categories, there are a wide variety of variations, with each variation designed to drill a formation having a general range of formation properties.

The fixed cutter drill bit is generally employed to drill the relatively young and unconsolidated formations while the roller cone type drill bit is generally employed to drill the older more consolidated formations. These two categories of drill bits generally constitute the bulk of the drill bits employed to drill oil and gas wells around the world. When a typical roller cone rock bit tooth presses upon a very hard, dense, deep formation, the tooth point may only penetrate into the rock a very small distance, while also at least partially, plastically "working" the rock surface. Under conventional drilling techniques, such working the rock surface may result in toughening the formation in such a way as to make it even more difficult to penetrate with a drill bit. This peening effect may equalize the compressive forces over the drilling surface, creating a toughened "skin" or "hard-face" on the formation.

With roller cone type drilling bits, a relationship exists between the WOB, the number of teeth that impact upon the formation, and the drilling RPM. This relationship may be roughly equivalent to a "shots per second" factor in shot peening metals to alter the properties of the metal surface. Since WOB may be relatively constant, the repeated pulsing action of the teeth upon the formation can cause work hardening of the formation and may thereby impede penetration by the rock bit into the formation. This effect may become more pronounced as formation depth, rock hardness and overburden forces increase.

Subsequent increases in WOB may assist the rate of penetration, but may also result in accelerated bit bearing wear, breakage of bit teeth, or both. Unanticipated changes in formation properties and formation drillability over the course of the well bore may result in a mismatch or less than ideal mix between bit type being used, controllable drilling parameters and formations actually encountered. Severe mismatches may result in accelerated bit wear, destruction, or both. Anticipation of such occurrences may result in the drilling operator operating the bit in a rather conservative mode to prevent damage to the bit and to avoid frequent bit replacements. Such replacements require additional time and equipment, resulting in increased well bore expenses.

The oil and gas exploration and production industry is projected to spend in excess of $100 billion dollars in the current FY2000 according to Arthur Anderson's—"Global E7P Trends" July 1999. As demonstrated, and from common knowledge within the oil and gas exploration and production industry, improvement in the rate of penetration in the drilling of a well bore can have a significant economic effect.

An improved method for cutting or drilling subterranean formations is desired in order to reduce well or excavation costs through increased rates of penetration, reduced bit wear and reduced drilling time. It is also desired to increase the efficient use of hydraulic and mechanical energy at a drill bit in drilling or cutting such formations. The disadvantages of the prior art are substantially overcome by the present invention, and an improved method and system for cutting or drilling through subterranean formations are hereinafter disclosed. This invention has particular utility in drilling well bores, cutting tunnels, pipe chases and other subterranean formation excavations.

SUMMARY OF THE INVENTION

A suitable method for drilling or cutting a subterranean formation according to the present invention includes concurrently engaging impactors with the formation being drilled while rotating a drill bit. In an exemplary application, a majority of the impactors may be substantially spherical steel shot having a mean diameter of from 0.150 to 0.250 inches. The impactors may be of sufficient mass and may be accelerated to sufficient velocity through a nozzle with which to impale into and/or engage the impactors with a formation and thereby effect substantial structural changes to the engaged formation. The anticipated formation changes to the formation matrix or structure are well beyond the changes that were possible with mere abrasives and/or high pressure fluids. The impactors of this invention substantially have a higher mass and size than prior abrasive or jetting particles, however, they are accelerated substantially to a velocity lower than the velocities used in abrasive or jetting technology. The impactors of this invention may be a plurality of independent, solid material, impactor bodies with a majority by weight of the impactors having a mean outer diameter of at least 0.100 inches.

Impacting a formation with a relatively large impactor while drilling may beneficially alter the structural properties of the formation to a depth not possible under prior art, so as to enhance the rate of penetration by the drill bit, through a number of combinations of both independent and interrelated mechanisms. These mechanisms include each of mechanical, thermal and hydraulic mechanisms, as discussed in the specification. Energy imparted into the formation ahead of the bit by the impactors may independently remove cuttings and formation, and may simultaneously and beneficially alter formation rock properties. The modified or altered formation may be more amenable to mechanical and/or hydraulic removal or cutting generation by rotational and gravitational energy in the bit teeth.

Such altered formation may also be more amenable to removal by the kinetic energy in subsequent impactor and in the cutting fluid. In addition, the effect of the impactors upon the formation may enhance expenditure of hydraulic energy at the formation face to hydraulically create and remove cuttings from the formation face. Impact from the impactor upon the formation may mechanically induce a plurality of micro-fractures, stress fractures or other formation deformations in the impacted area, which may then be more readily hydraulically exploited. Such enhanced hydraulic action and mechanical deformations may reduce the work required by the bit teeth to both create and remove the formation cuttings, thereby extending bit life while increasing the rate of penetration.

Under prior art, the use of abrasive particles entrained within drilling fluid in drilling operations has been to relieve relatively small particles from the drilled surface. Under such operations, the relieved formation particles typically have a mass or size substantially equal or less than the mass or size of the abrasive particle. This disclosure is related to the use of relatively larger impactors with the significance event mechanism being formation deformation, fracturing, structural alteration or propagation therein by the impactor. Such events may result in or create mechanical advantages, force point location changes, overburden stress relief in localized areas and dynamic mixing with the formation. One impactor may remove several hundred rock grains or particles. An additional benefit may be to cause a fundamental shift in the understanding and application of rock drilling mechanics, theories, and techniques.

It is significant in this invention that a substantial portion of the mechanical advantages are obtained by impact mechanics as opposed to the abrasive mechanics of prior art. Impactors entrained within a drilling fluid are accelerated through one or more nozzles in or near the bit. Although generally accelerated to a lower velocity than prior art abrasives, due to their higher mass and larger size, a substantial portion by weight of the impactors may impact the formation ahead of the bit consistently with sufficient energy to structurally alter and/or at least partially penetrate into the formation, to a depth beyond the first two layers of encountered formation grain material or particles. In many instances, the impactors will be impacted into the formation to a depth several times the diameter of the impactor. Such technique is significantly distinguishable from the abrasive and high-pressure hydraulic methods of the prior art in that under prior art the formation was not deformed beyond the first layer of formation grain material or particles. The impactors may act independent from the cutting and compressing action of the bit, and the impactors may act in concert with the mechanical, cutting and compressing actions of the bit to further enhance rate of penetration.

An impactor based drilling system for drilling well bores may be performed using substantially conventional drilling equipment as known and used in drilling well bores. A drilling rig including a fluid pump may pump a drilling fluid down a drill string from the drilling rig to a drill bit. The drilling fluid may be pumped by a fluid pump, through the drill string and through one or more bit nozzles as the bit is rotated while in engagement with the formation. The drilling fluid and cuttings may be circulated substantially back to the surface where the drilling fluid may be separated from the cuttings, such that the drilling fluid may be recirculated in the well bore. Additional known equipment may also be provided, including an impactor pump, such as a progressive cavity pump, to pump a slurry including impactors into the drilling fluid stream.

The impactors are geometrically larger than particulate material used for drilling or formation cutting under prior art, such as abrasives. In a preferred embodiment, the impactors are substantially spherical steel shot or BBs, having a mean diameter of at least 0.100 inches. The impactors are typically pumped at conventionally low drilling fluid circulation pressures and typically exit the bit nozzle such that a majority by weight of the impactors exiting the nozzle may impact the formation at a velocity less than 750 feet per second. The momentum of the impactors provides sufficient energy at the formation face, even at the relatively low velocity, to effect the desired formation structural distortion, alteration, penetration and/or fracturing. A plurality of individual impactors may be introduced into the fluid system and subsequently engaged with the formation substantially sequentially and continuously with respect to the other impactors introduced into the system.

The plurality of solid material impactors may be introduced into the cutting or drilling fluid to circulate the impactors with the fluid, through the cutting or drill bit and into engagement with the formation.

A cutting fluid or drilling fluid may be pumped at a pressure level and a flow rate level sufficient to satisfy an impactor mass-velocity relationship wherein a substantial portion by weight of the impactors may create a structurally altered zone in the formation. A substantial portion means at least five percent by weight of the impactors, and more particularly at least twenty-five percent by weight, and even more particularly, at least a majority by weight of the plurality of solid material impactors introduced into the drilling fluid. The structurally altered zone may have a structurally altered zone height in a direction perpendicular to a plane of impaction at least two times a mean particle diameter of particles in the formation impacted by the plurality of solid material impactors.

It is an object of the present invention to provide an improved system and method for cutting a formation, such as when drilling a well bore. The techniques of this invention may facilitate drilling well bores or cutting earthen formations in a commercially improved manner.

It is also an object of this invention to provide a method for drilling or cutting through formations with improved bit efficiency and rates of penetration. This invention may provide techniques which may significantly improve bit efficiency and rates of penetration. Such improvements may be realized through formation alteration, mechanical effects from both the impactors and the bit, and from improved use of hydraulic power at the bit.

It is further an object of this invention to provide improved methods of cutting or drilling through formations possessing a variety of formation properties. The methods and systems of this invention may be effectively applied to relatively soft formations as well as relatively hard or conventionally difficult to drill formations.

A further object of this invention is to provide improved methods and systems for cutting or drilling through formations in a variety of applications. The methods and systems of this invention may be applied to the drilling of well bore, such as used in oil and gas drilling, and geothermal drilling. In addition, the methods and systems of this invention may be effectively applied to mining, tunneling, cutting pipe chases, trenches, foundation piers and other earthen excavation operations.

It is also an object of this invention to provide methods and systems for supplementing the mechanical action of the bit with a fluid based impactor delivery system with sufficient energy to satisfy a mass-velocity relationship sufficient to supplement and/or assist the mechanical action of the bit.

It is an additional object of this invention to provide methods and systems for introducing solid material impactors into a drilling fluid to impart energy generated in the impactors into the formation generally ahead of the drill bit. The impactors utilized by this invention are relatively large as compared to abrasive type particles. The introduction of impactors into the drilling fluid and subsequently increasing the velocity of the impactors while passing through a nozzle can sufficiently energize the impactors to alter the structural properties of the formation matrix. Such altered matrix may subsequently be exploited mechanically and hydraulically by the drill bit. The impactors may also effect removal of multiple grains or chips of formation as a direct result of the impact event.

It is a feature of this invention that the invention may utilize impactors having a mean diameter or length dimension of at least 0.100 inches. In a preferred embodiment, a majority by weight of the impactors may include a mean diameter between 0.150 inches and 0.250 inches. Other embodiments may utilize even larger impactors.

It is also a feature that the impactors may be at least partially energized through either a convention bit nozzle or through other known non-convention nozzles, such as a dual jet nozzle. Special nozzles may also be designed to accommodate or energize the impactors.

It is a further feature of this invention that the impactors may be generally spherically shaped, crystalline shaped, including angular and sub-angular shaped, or specially shaped. The impactors may also be metallic, such as steel, thereby having a relatively high density and high compressive strength. Alternatively, other materials may be utilized which may possess desirable properties as appropriate to the application at hand. For example, a particular application may be best optimize by an impactor possessing a relatively high surface area to weight ratio, or low density with high crush resistance.

It is a feature of this invention that the required energy levels in the impactors may be achieved by relatively low impactor velocities at the point of impact. Impactor velocities at the point of impact may typically be less than 750 feet per second for impactors each having a mean diameter in excess of 0.100 inches.

Yet another feature of the invention that the impactors may create a structurally altered zone or matrix in the formation having an altered length, height, width, or any combination thereof, of at least two times a mean particle diameter of particles in the formation impacted by the impactor. The alteration may be due to the impactor impact, the interaction of the bit with the respective impactor, the interaction of multiple impactors, or any combination thereof.

Another significant feature of this invention is that the impactors may facilitate leveraging the rotational and gravitational forces of the bit to act angularly or laterally within the formation being drilled or cut, to effect cutting generation.

It is a feature of this invention that the rate of impactor introduction into the drilling fluid may be altered as desired, or as determined from drilling parameters or formation characteristics. For example, when drilling a well bore, relatively fewer impactors may be desired when drilling a hard formation as compared to the number of impactors desired when drilling a relatively gummy formation.

It is also a feature of this invention that the methods and systems of this invention may be applied to many subterranean excavation, cutting and/or drilling operations. Applicable operations may include drilling a well bore in the oil and gas industry, geothermal wells, tunnels, pipe chases, foundation piers, or other earthen penetrations.

It is an advantage of this invention that the invention may generally utilize existing drilling rig equipment. Additional known equipment may be included, such as an impactor source vessel, impactor mixing vessel, an impactor slurry pump and line, and an impactor introduction port. For example, the introduction port may be a port on the gooseneck above a rotary swivel.

It is also an advantage of the invention that very little additional training or skill may be required of the crews operating the drilling rig. Some experience and skill may otherwise be useful in adjusting the impactor introduction rate. However, even impactor rate adjustment may not require much more skill than other related drilling decisions, such as weight on bit, rotary speed, pump rate and pump pressure. Such determinations are regularly made during drilling and cutting operations.

Yet another advantage of this invention is that it may be practiced utilizing equipment that is known in the drilling and formation cutting industries. Although some known equipment may be adapted that would not otherwise have been adapted for use with this invention, the invention does rely upon novel equipment for an operation embodiment. For example, a progressive cavity pump may pump the impactor slurry and a drill bit may utilize a standard size set of bit nozzles.

Still a further advantage of the invention that the footage drilled by a given drill bit may be significantly increased and that bit life may be extended by reducing the amount of work per unit time and work per unit distance that the bit must perform. Such advantages may also reduce rig time by reducing the number of bit trips required to change drill bits.

A significant advantage of this invention is that the additional costs for including this invention in a drilling or cutting operation may be relatively nominal as compared to the total drilling costs. In addition, the additional costs may be significantly offset by the increased rates of penetration and decreased rig time.

The methods and systems described herein are not limited to specific impactor sizes or shapes but rather controlled by the physical and material sciences of force, velocity, melting points, rock properties, mechanics, hydraulics, compressive and fracture characteristics, porosity, etc. This invention may be applied broadly and to other fields of endeavor where the cutting of earthen formations or other materials, such as concrete, by impact mechanics rather than abrasion is important. These and further objects, features, and advantages of the present invention will become apparent from the following detailed description, wherein reference is made to figures in the accompanying drawings.

DETAILED DESCRIPTION OF PREFERRED EMBODIMENTS

Figure 1:
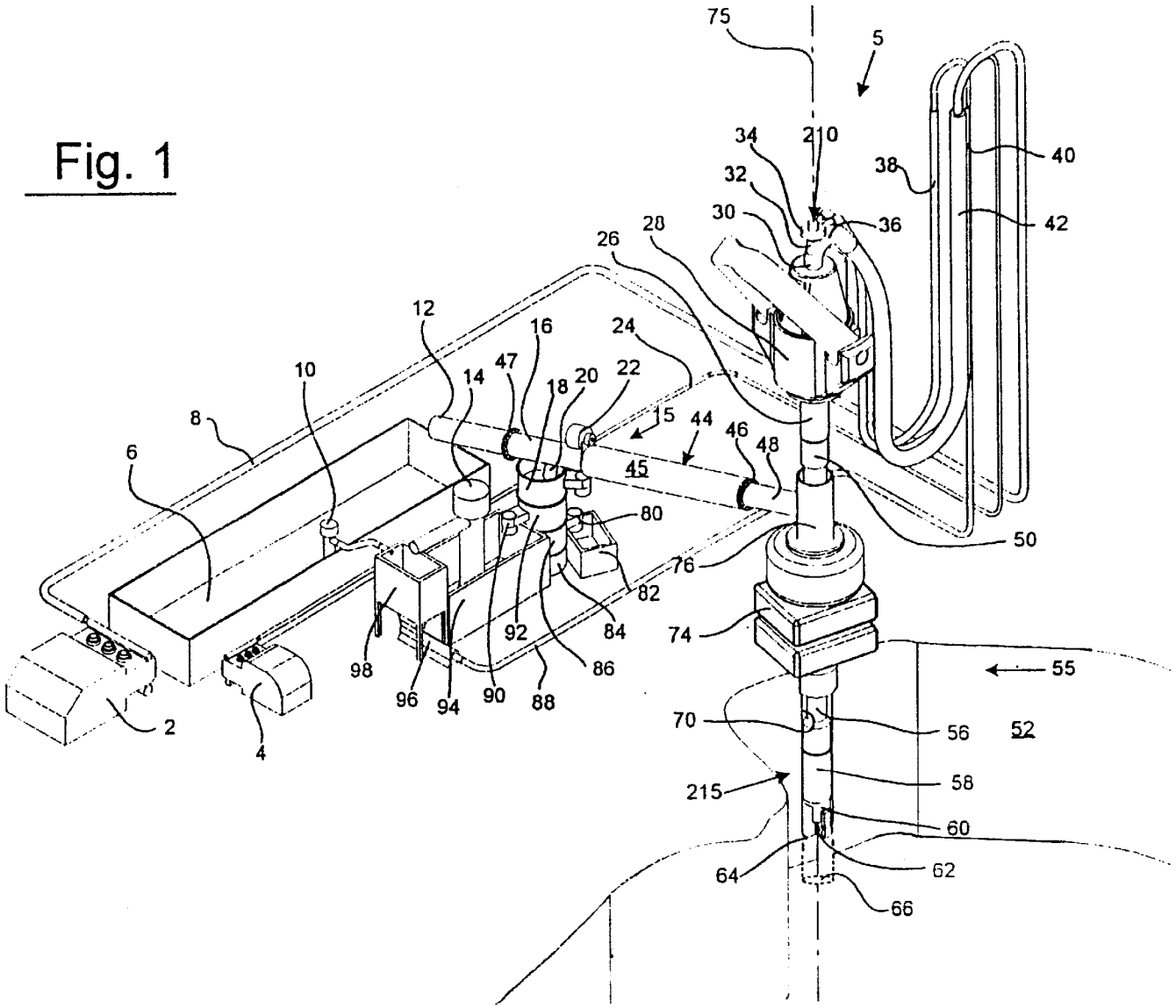
FIG. 1 is an isometric view of a drilling system as used in a preferred embodiment.

Methods and systems are disclosed for cutting a subterranean formation 52 with a drill bit 60. FIG. 1 illustrates a suitable embodiment for a drilling system including solid impactors 100 to engage the subterranean formation 52 in cooperation with a drill bit 60 to cut the formation 52. The rate of penetration of a drill bit 60 through a formation may be substantially increased with the methods and systems of this invention. In considering the mechanics of this invention and the surprisingly improved rates of penetration obtained in experimentation, several theories are advanced herein to explain a portion of the improved rates. This invention may afford combined or separate benefits from each of two fundamental engineering sciences to achieve the improved penetration rates: (1) Impact mechanics affording a dynamic contribution, and (2) force concentration and leveraging mechanics affording a substantially static contribution.

A broad theme of this invention may be summarized as creating a mass-velocity relationship in a plurality of solid material impactors 100 transported in a fluid system, such that a substantial portion by weight of the impactors 100 may each have sufficient energy to structurally alter a targeted formation 52 in a vicinity of a point of impact. Preferably, the structurally altered zone 124 may be altered to a depth 132 of at least two times the mean diameter of the particles 150 in the formation 52. The mean diameter of particles 150 in the formation 52 may be determined by established standards for grading and sizing formation particles 150. For example sizing and grading may be determined by United States Geological Service sizing and sieve grading. A substantial portion means at least five percent by weight of the plurality of solid material impactors, and more particularly at least twenty-five percent by weight of the plurality of solid material impactors introduced into the drilling fluid. Even more particularly, substantial portion means at least a majority by weight of the plurality of solid material impactors introduced into the drilling fluid.

Figure 2:
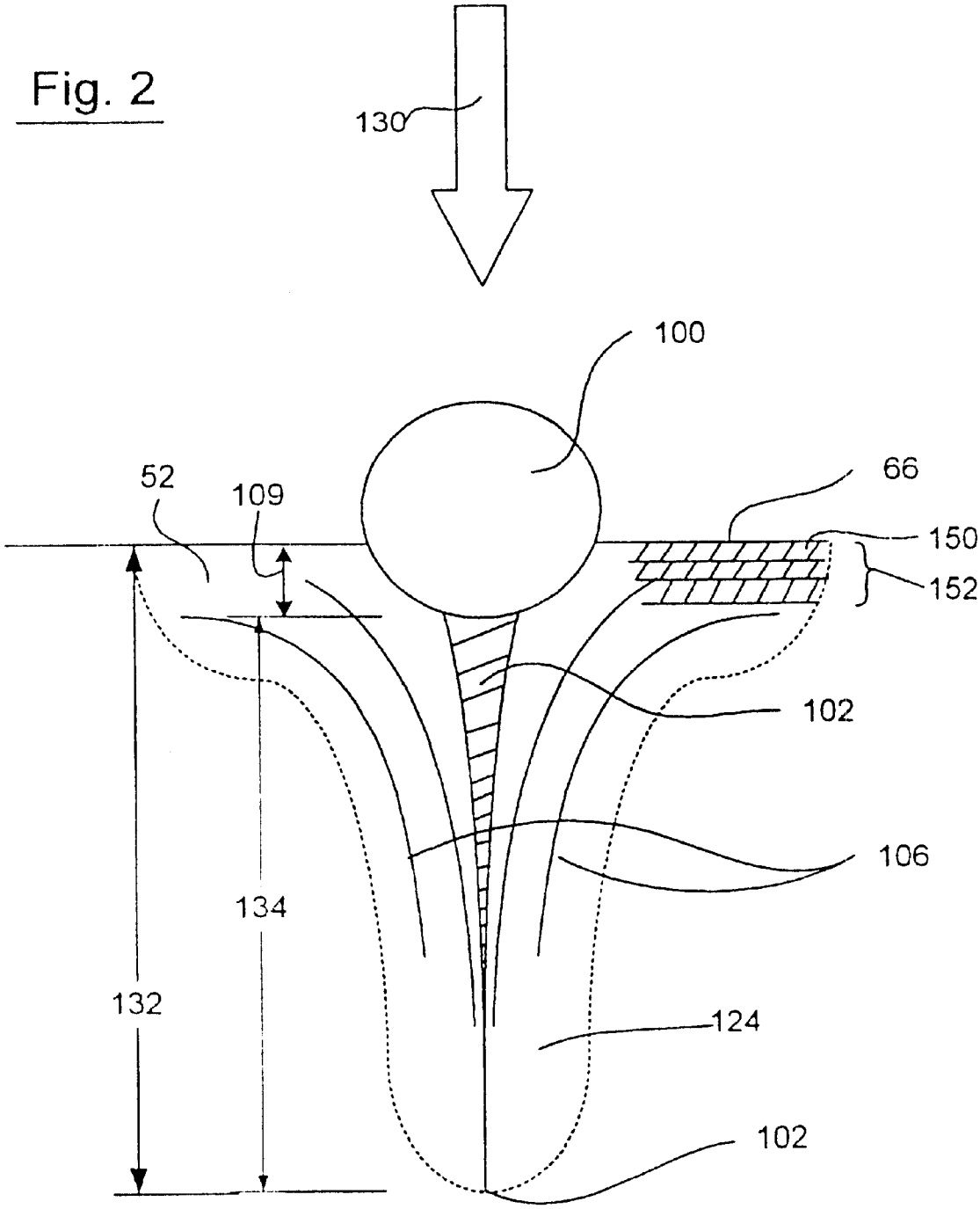
FIG. 2 illustrates an impactor impacted with the formation, creating a cavity, a structurally altered compressive "spike" ahead of the impactor and a structurally altered zone in the formation in the vicinity of the impact.

A formation particle 150 may be defined as the most basic granular or crystalline structure that comprises a portion of the formation matrix. For simplification purposes, FIG. 2 illustrates a plurality of formation particles 150 arranged very simply in layers and the particles 150 being rather well sorted and neatly arranged. FIGS. 2 through 5B also illustrate formation surface 66, which may also be referred to as a plane of impaction 66, as relatively smooth, planar surface. It will be understood by those skilled in the art that many different particle 150 sizes, sorting distributions, packing arrangements and layering may be encountered in formations 52. It will also be understood that in most circumstances, the plane of impaction 66 may rarely be perfectly planar, but rather at a granular level may be composed of various undulations, discontinuities and/or irregularities. However, it is understood that a substantial portion by weight of the impactors of this invention may effect structural alterations in the formation 52 as claimed and described in this specification and claims. It is also understood that mechanical impaction of a relatively large impactor 100, such as may be several times the diameter of a formation particle diameter, may effect a greater magnitude of structural alteration in the formation than may have been effected on a perfectly smooth, planar surface. Such effectiveness is a portion of the essence of the performance of this invention.

A plurality of solid material impactors 100 may be commingled with a drilling fluid and pumped through a nozzle 64 in a drill bit 60 to cause the impactors 100 to engage a plane of surface 66 of a formation 52. Each of the individual impactors 100 are structurally independent from the other impactors. For brevity, the plurality of solid material impactors 100 may be interchangeably referred to as simply the impactors 100. A substantial portion by weight of the impactors 100 may engage the formation 52 with sufficient energy to effect direct removal and cutting of a portion of the formation and/or to sufficiently alter a portion of the structural properties of the formation that the formation may be more easily cut by the drill bit 60.

In a preferred embodiment of a formation cutting system according to this invention, solid material impactors 100 may be substantially spherically shaped, non-hollow, formed of rigid metallic material, and having high compressive strength and crush resistance, such as steel shot, ceramics, depleted uranium, and multiple component materials. The impactors 100 are solid material impactors as opposed to fluid material impactors. Although in a preferred embodiment the solid material impactors are substantially a non-hollow sphere, alternative embodiments may provide for solid material impactors, which may include a impactors with a hollow interior.

A majority by weight of the impactors applicable to this invention are dimensionally larger and of a relatively greater mass than particles used under prior art technology, such as abrasive jetting. The impactors 100 may be selectively introduced into a drilling fluid circulation system, such as illustrated in FIG. 1, near a drilling rig 5, circulated with the drilling fluid ("drilling mud") to the drill bit 60 positioned in a well bore 70, and accelerated through at least one nozzle in the drill bit 60.

Referring to FIGS. 1 through 5B, a substantial portion by weight of the impactors 100 may engage the formation 52 with sufficient energy to enhance creation of a well bore 70 through the formation 52 by any or a combination of different mechanisms. In a first mechanism, an impactor 100 may directly remove a larger portion of the formation 52 than may be removed by abrasive type particles. In another mechanism, an impactor 100 may penetrate into the formation 52 without removing formation material from the formation 52. A plurality of such formation penetrations, such as near and along an outer perimeter of the well bore 70 may relieve a portion of the stresses on a portion of formation being cut or drilled, which may thereby enhance a drilling or cutting action of the bit 60.

In yet another mechanism, an impactor 100 may alter one or more physical properties of the formation 52 ahead of the bit 60. Such physical alterations may include creation of micro-fractures and increased brittleness or density in a portion of the formation 52, which may thereby enhance effectiveness the bit 60 in drilling or cutting the formation.

An additional mechanism that may enhance drill bit effectiveness may include engaging a single impactor or a "stack" of impactors with a drill bit tooth 108 to leverage, wedge, pry or otherwise cause one or more of the impactors to re-orient a portion of the weight-on-bit (WOB) force. The re-oriented force may be imposed upon the formation 52 in one or more directions of lower resisting stress, such as laterally or substantially transverse to a borehole axis 75 near the bit 60. Thereby a portion of formation 52 may be removed directly by the WOB force, or alter one or more formation characteristics to facilitate subsequent removal hydraulically and/or by the drill bit 60. These and other mechanisms are discussed below, in more detail.

FIG. 1 illustrates an embodiment of a portion of a drilling rig 5 according to the present invention, particularly illustrating a drilling fluid circulation system, including a drill bit 60 and drill string 55. A well bore 70 is illustrated, cut or drilled through a subterranean formation 52 with a drill bit 60 at the bottom of the well bore 70. The drill bit 60 may be attached to a drill string 55 comprised of drill collars 58, drill pipe 56, and kelly 50. An upper end of the kelly may interconnected with a lower end of a swivel quill 26. An upper end of the swivel quill maybe rotatably interconnected with a swivel 28. The swivel 28 may include a top drive assembly (not shown) to rotate the drill string 55. The drill bit 60 may engage a bottom surface 66 of the well bore 70. The swivel 28, the swivel quill 26, the kelly 50, the drill string 55 and a portion of the drill bit 60 each may include an interior passage that allows drilling mud to circulate through each of the aforementioned components. Drilling fluid may be withdrawn from a mud tank 6, pumped by a mud pump 2, through a through medium pressure capacity line 8, through a medium pressure capacity flexible hose 42, through a gooseneck 36, through the swivel 28, through the swivel quill 26, through the kelly 50 located on top of a drill string, and through the drill string 55 and through the bit 60.

The solid material impactors 100 may be introduced, such as by being pumped or displaced, into the drilling fluid at a convenient location near the drilling rig 5, such as through an injector port 30 in the goose neck 36. Impactors 100 may be provided in an impactor storage tank 94. A screw elevator 14 may transfer a portion of the impactors at a selected rate from the storage tank 94, into a slurrification tank 98. A pump 10, preferably such as a progressive cavity pump may transfer a selected portion of the drilling fluid from a mud tank 6, into the slurrification tank 98 to be mixed with the impactors 100 in the tank 98 to form an impactor concentrated slurry. The impactor concentrated slurry may be pumped at a selected rate and pressure with a pump 96 capable of pumping the impactor concentrated slurry, such as a progressive cavity pump, through a slurry line 88, through a slurry hose 38, through an impactor slurry injector head 34 and through an injector port 30 located on the gooseneck 36.

When introducing impactors 100 into the drilling fluid, the rate of drilling fluid pumped by the mud pump 2 may be reduced to a rate lower than the mud pump 2 is capable of efficiently pumping. In such event, a lower volume mud pump 4 may pump the drilling fluid through a medium pressure capacity line 24 and through the medium pressure capacity flexible hose 40.

Pump 4 may also serve as a supply pump to drive the introduction of impactors 100 entrained within an impactor slurry, into the high pressure drilling fluid stream pumped by mud pumps 2 and 4. Pump 4 may pump a percentage of the total rate drilling fluid being pump by both pumps 2 and 4, such that the fluid pumped by pump 4 may create a venturi effect and/or vortex within the injector head 34 by which to induct the impactor slurry being conducted through line 42, through the injector head 34, and then into the high pressure drilling fluid stream.

From the swivel 28, the slurry of drilling fluid and impactors ("slurry") may circulate through the interior passage in the drill string 55 and through the drill bit 60. At the drill bit 60, the slurry may circulate through at least one bit nozzle 64 in the drill bit 60. The bit nozzles 64 may include a reduced inner diameter as compared to an inner diameter of the interior passage in the drill string 55 immediately above the drill bit 60. Thereby, the nozzles 64 may accelerate the velocity of the slurry as the slurry passes through the nozzles 64. The nozzles 64 may also direct the slurry into engagement with a selected portion of the bottom surface 66 of well bore 70.

The bit 60 may be rotated relative to the formation 52 and engaged therewith by an axial force (WOB) acting at least partially along the well bore axis 75 near the drill bit 60. The bit 60 may include a plurality of bit cones 62, which also may rotate relative to the bit 60 to cause bit teeth 108 secured to a respective cone to engage the formation 52, which may generate formation cuttings substantially by crushing, cutting or pulverizing a portion of the formation 52. The bit teeth 108 may also be comprised of fixed cutter teeth which may be substantially continuously engaged with the formation 52 and create cuttings primarily by shearing and/or axial force concentration to fail the formation, or create cuttings from the formation 52.

As the slurry is pumped through the nozzles 64, a substantial portion by weight of the impactors 100 may engage the formation with sufficient energy to enhance the rate of formation removal or penetration (ROP) by the drill bit 60, such as through one of the mechanisms discussed previously. The formation removed by the drill bit, the drilling fluid and/or the impactors may be circulated from within the well bore 70 near the drill bit 60, and carried suspended in the drilling fluid with at least a portion of the impactors, through a well bore annulus between the OD of the drill string and the ID of the well bore 70. At the rig 5, the returning slurry of drilling fluid, formation fluids (if any), cuttings and impactors 100 may be diverted at a drilling nipple 76, which may be positioned on a BOP stack 74. The returning slurry may flow from the drilling nipple 76, into a return flow mud line 15, which maybe comprised of tubes 48, 45, 16, 12 and flanges 46, 47. In a preferred embodiment, the mud return line 15 may include an impactor reclamation tube assembly 44, as illustrated in FIG. 1, which may preliminarily separate a majority of the returning impactors 100 from the remaining components of the returning slurry. Drilling fluid and other components entrained within the drilling fluid may be directed across a shale shaker (not shown) or into a mud tank 6, whereby the drilling fluid may be further processed for re-circulation into a well bore.

The reclamation tube assembly 44 may operate by rotating tube 45 relative to tube 16. An electric motor assembly 22 may rotate tube 44. The reclamation tube assembly 44 comprises an enlarged tubular 45 section to reduce the return flow slurry velocity and allow the slurry to drop below a terminal velocity of the impactors, such that the impactors 100 can no longer be suspended in the drilling fluid and may gravitate to a bottom portion of the tube 45. This separation function may be enhanced by placement of magnets near and along a lower side of the tube 45. The impactors 100 and some of the larger or heavier cuttings may be discharged through discharge port 20. The separated and discharged impactors 100 and solids discharged through discharge port 20 may be gravitationally diverted into a vibrating classifier 84 or may be pumped into the classifier 84. A pump (not shown) capable of handling impactors and solids, such as a progressive cavity pump may be situated in communication with the flow line discharge port 20 to conduct the separated impactors selectively into the vibrating separator 84 or elsewhere in the drilling fluid circulation system.

The reclamation tube assembly 44 may separate a portion of the returned impactors 100, a portion of other solid materials such as formation cuttings, and a portion of the drilling fluid, each of which may be directed into the top of a vibrating classifier 84. The vibrating classifier 84 may be a type such as commonly used in the mining industry whereby vibrating screens may classify the impactors and solid material into various grades according to coarseness or size. A selected portion of the classified materials may be retained for re-use such as impactors 100 in a select size range.

In a preferred embodiment, the vibrating classifier 84 may comprise a three screen section classifier of which screen section 18 may remove the coarsest grade material. The removed coarsest grade material may be selectively directed by outlet 78 to one of storage bin 82 or pumped back into the flow line 15 downstream of discharge port 20. A second screen section 92 may remove a re-usable grade of impactors 100, which in turn may be directed by outlet 90 to the impactor storage tank 94. A third screen section 86 may remove the finest grade material from the drilling fluid. The removed finest grade material may be selectively directed by outlet 80 to storage bin 82, or pumped back into the flow line 15 at a point downstream of discharge port 20. Drilling fluid collected in a lower portion of the classified 84 may be returned to a mud tank 6 for re-use.

A majority by weight of the plurality of solid material impactors 100 for use in this invention are preferably at least 0.100 inches in mean diameter. More preferably, a majority by weight of the impactors 100 may be at least 0.125 inches in diameter and may be as large as 0.333 inches in mean diameter. Even more preferably, a majority by weight of the impactors 100 may be at least 0.150 inches in mean diameter and may be as large as 0.250 inches in mean diameter.

A majority by weight of the impactors 100 preferably may be accelerated to a velocity of at least 200 feet per second, at substantially the point of impact with the formation 52. More preferably the impactors a majority by weight of the impactors 100 may be accelerated to a velocity of at least 200 feet per second and as great as 1200 feet per second, at substantially at the point of impact. Even more preferably, a majority by weight of the impactors 100 may be accelerated to a velocity of at least 350 feet per second and as great as 750 feet per second, substantially at the point of impact. Still even more preferably, a majority by weight of the impactors 100 may be accelerated to a velocity of at least 350 feet per second and as great as 500 feet per second, substantially at the point of impact. It may be appreciated by those skilled in the art that due to the close proximity of a bit nozzle 60 to the formation being impacted, such as in a bit providing extended nozzles or extended nozzle skirts, the velocity of a majority of impactors 100 exiting the bit nozzle 60 may be substantially the same as a velocity of an impactor 100 at a point of impact with the formation 52. Thus, in many practical applications, the above velocity values may be determined or measured at substantially any point along the path between near an exit end of a bit nozzle 60 and the point of impact, without material deviation from the scope of this invention. Likewise, those skilled in the art will also appreciate that losses in velocity of fluid moving between the bit nozzle and the formation may be exponential, due at least in part to fluid expansion and diffusion. Velocity losses in an impactor will also occur, however, because an impactor 100 does not substantially deform, velocity losses in the impactor 100 may not be as significant as losses in the fluid. Thereby, where the standoff distance between the formation and the bit nozzle is significant, the velocity of an impactor 100 should be defined as the velocity of the impactor 100 at or near the formation, immediately prior to impact with the formation 52.

The impactors 100 are preferably, substantially spherically shaped, rigid, solid material, non-hollow, metallic impactors, such as steel shot. The impactors may be substantially rigid and may possess relatively high compressive strength and resistance to crushing or deformation as compared to physical properties or rock properties of a particular formation or group of formations being penetrated by the well bore 70.

Impactors 100 may be selected based upon physical factors such as size, projected velocity, impactor strength, formation 52 properties and desired impactor concentration in the drilling fluid. Such factors may also include; (a) an expenditure of a selected range of hydraulic horsepower across the one or more bit nozzles, (b) a selected range of drilling fluid velocities exiting the one or more bit nozzles or impacting the formation, and (c) a selected range of solid material impactor velocities exiting the one or more bit nozzles or impacting the formation, (d) one or more rock properties of the formation being drilled, or (e), any combination thereof.

FIG. 2 illustrates an impactor that has been impaled into a formation 52, such as a lower surface 66 in a well bore 70. For illustration purposes, the surface 66 is illustrated as substantially planar and transverse to the direction of impactor travel 130. A substantial portion by weight of the impactors 100 circulated through a nozzle 60 may engage the formation with sufficient energy to effect one or more rock properties of the formation. The formation may be altered or effected to an altered zone depth 132, measured normal to a plane of impaction 66 of at least two times the mean diameter of particles 150 of the formation 52, in the immediate vicinity of the point of impact. Reference number 152 and the associated bracket illustrates generally, a depth normal to the plane of impaction 66 that is two times the mean diameter of particles 150 in the formation 52.

According to some theories, a portion of the formation ahead of the impactor 100 substantially in the direction of impactor travel 130 may be altered such as by increased density, micro-fracturing and/or thermal alteration due to the impact energy, which may result in a compressive spike 102. The compressive spike may have a spike length 134. In such occurrence, the altered zone 124 may include an altered zone depth 132. The density of the spike 102 may be increased to substantially the density of the impactor 100 and may be at least four times the diameter of the impactor 100 in spike length 134.

An additional area near a point of impaction may be altered, such as by the creation of micro-fractures 106, and may be referred to as an altered zone 124. The altered zone 124 may be broken or other wise altered due to the impactor and/or a drill bit 60, such as by crushing, fracturing or micro-fracturing 106. Due at least partially to one or more altered formation properties, subsequent interaction between the compressive spike 102 and an additional impactor and/or a tooth 108 on a drill bit, the compressive spike 102 may act as a wedge which may be driven further into the formation 52 ahead of the drill bit 60.

Figure 5A:
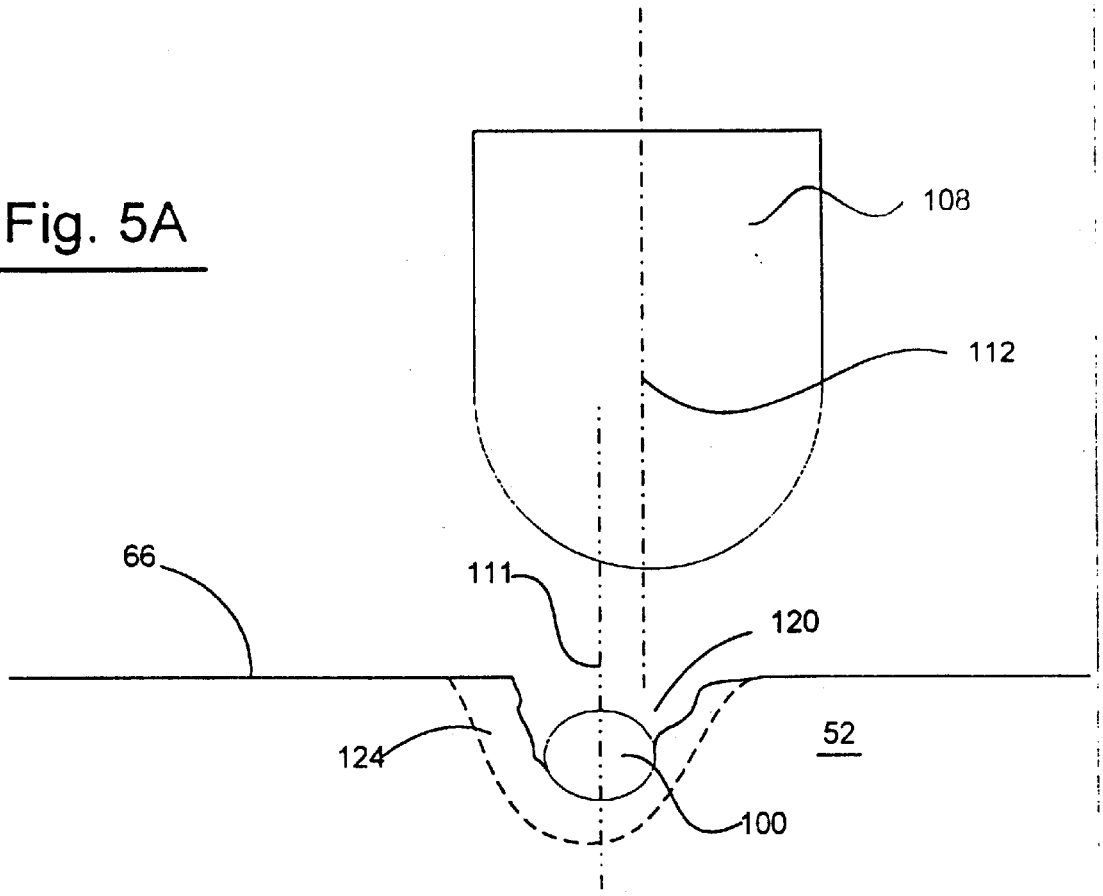
FIG. 5A illustrates an impactor propagated into the formation thereby creating a partial excavation near the surface and an altered zone in the vicinity of the impactor, and further illustrates a drill bit tooth positioned substantially above the impactor.
Figure 5B:
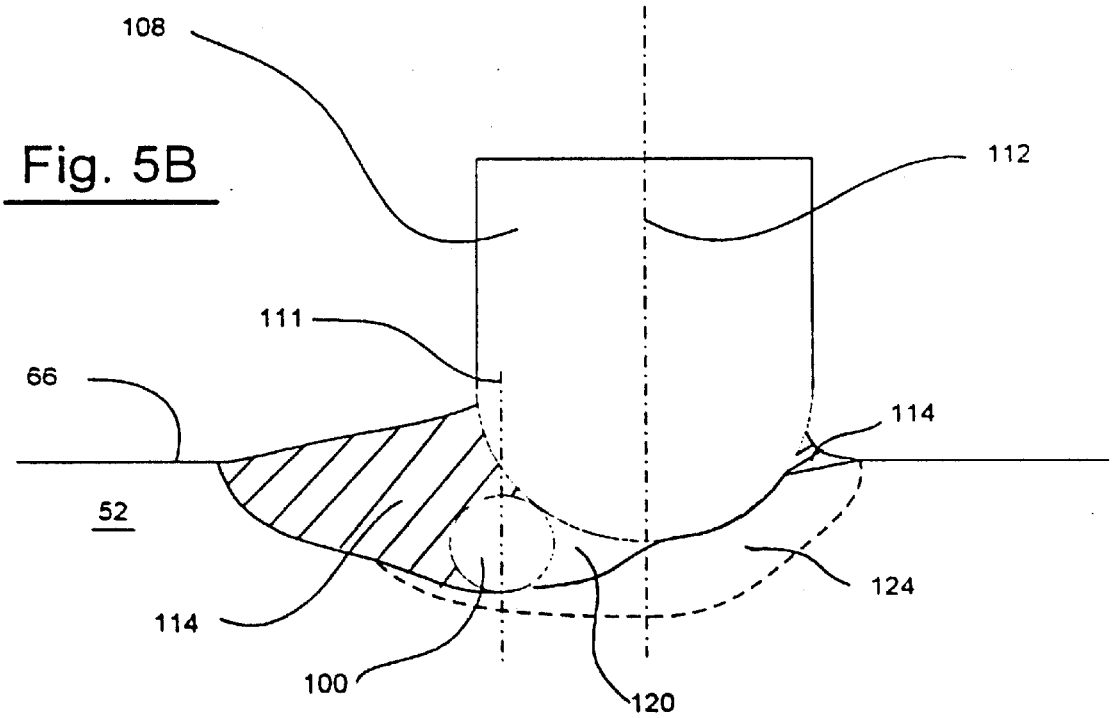
FIG. 5B illustrates the view illustrated in 5A at later point in time wherein the bit tooth has engaged the impactor, thereby skewing the impactor down and to the left, further altering the structurally altered zone. Further illustrated is the excision of a significant sized cutting by the laterally directed resultant forces from the forces imposed upon the impactor by the tooth skewing the impactor.

In circumstances wherein an impactor 100 may be postured as shown in FIG. 2, wherein at least a portion of the impactor may be positioned above a formation plane of impaction 66, a tooth 108 and/or cone 62 on a bit 60 may subsequently engage the impactor 100, as illustrated in FIGS. 5A and 5B. Such engagement may enhance formation cutting and/or bit performance by permitting a substantial portion of the WOB to be focused in the impactor and in the engaged formation.

Figure 3:
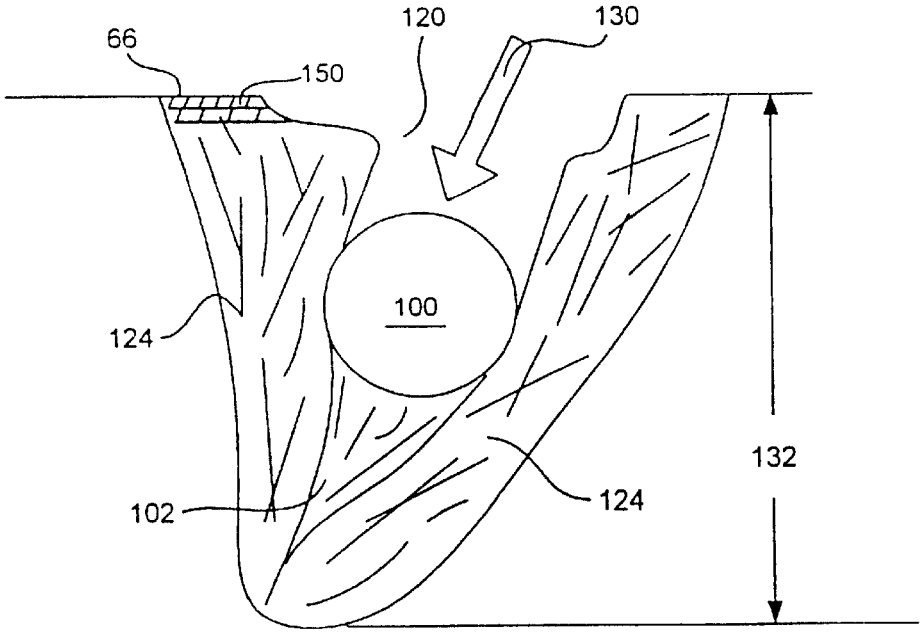
FIG. 3 illustrates an impactor embedded into the formation at an angle to a normalized surface plane of the target formation, which is embedded to a depth of approximately twice the diameter of the impactor, further illustrating material ejected near the formation surface as a result of the impact, a structurally altered zone and a compressive spike ahead of the impactor.

FIG. 2 also illustrates an impactor implanted into a formation 52 and having created a crater 120 wherein material has been ejected from or crushed beneath the impactor. Thereby a void or crater may be created, which as illustrated in FIG. 3 may generally conform to the shape of the impactor 100. FIGS. 3 through 5B illustrate craters 120 or voids 120 where the size of the crater may be larger than the size of the impactor 100. In FIG. 2, the impactor 100 is shown as impacted into the formation 52 yielding a crater depth 109 of a slightly less than one-half the diameter of the engaged impactor 100.

FIG. 3 illustrates an incident of interaction between an impactor 100 and a formation 52, wherein the impactor 100 engaged the formation 52 at an angle other than normal to a formation surface plane 66. The impactor 100 may penetrate into the formation 52 to a penetration depth 132 of several times a mean grain diameter 150. A compressive spike or zone 102 may be created ahead of the impactor in the direction of impactor travel 130, and an altered zone 124 may be created near a point of impaction. An excavated portion 120 may be created by the impact of the impactor 100 with the formation 52, which may result in the generation of cuttings or pulverized particulate material ejected and/or hydraulically removed from the formation 52.

Figure 4:
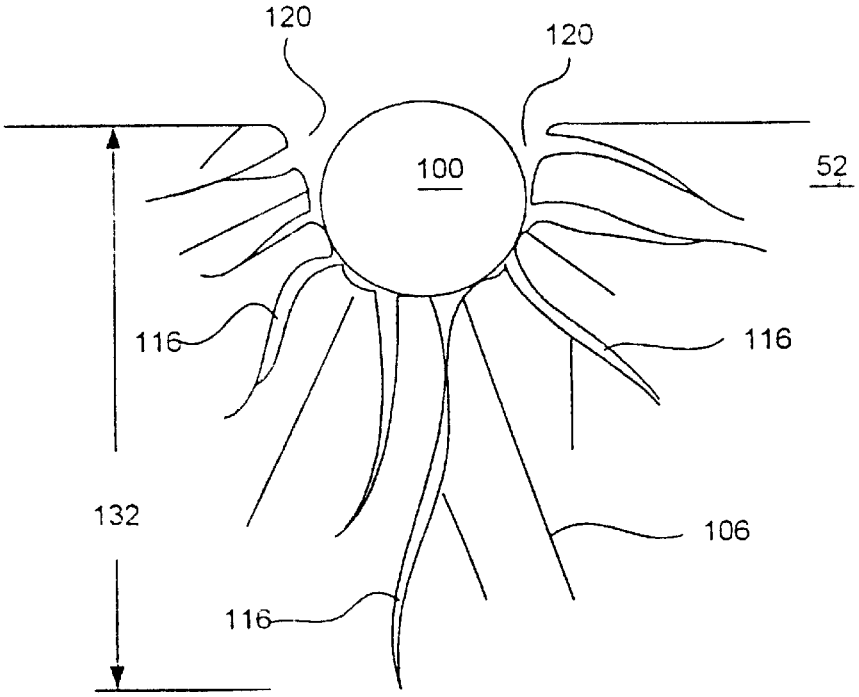
FIG. 4 illustrates an impactor impacting a friable or fracturable formation with a plurality of fractures induced by the impact, and a structurally altered zone in the vicinity of the impacted formation.

An additional theory for impaction mechanics in cutting a formation may postulate that a compressive spike may not be created in certain formations. Certain formations 52 may be highly fractured or broken up by impactor energy. FIG. 4 illustrates an interaction between an impactor 100 and a formation 52. A plurality of fractures 116 and micro-fractures 106 may be created in the formation 52 by impact energy. Formation properties may be altered to an altered zone depth 132, which may be several times the mean diameter of the respective impactor 100.

FIG. 5A may be illustrative of an incidence of impaction wherein a portion of formation 120 has been removed by the impaction energy. A formation altered zone 124 may be created in the vicinity of the point of impaction. An axial position of the impactor may be represented by center line 111. An axial position of a bit tooth 108 may be represented by center line 112. The bit tooth may substantially be moving toward the formation surface plane 66 along centerline 112.

FIG. 5B may illustrate the incident illustrated in 5A, at a later point in time, wherein the bit tooth 108 has engaged the impactor 100. Such engagement may result in the impactor being further displaced within the formation 52. For example, as illustrated in FIG. 5B, the bit tooth may cause the impactor 100 to be displaced downward and to the left, as viewed in FIG. 5B. The distance between centerline 111 and centerline 112 is greater in FIG. 5B, than the distance between the centerlines at an earlier period in time, as illustrated in FIG. 5A, illustrating lateral displacement of the impactor 100.

Displacement of the impactor 100 from the engagement with the bit tooth 108 may serve to direct a portion of engagement forces, including a portion of each of WOB and rotational forces, laterally into the adjacent formation. In addition, the impactor may be dragged, pushed, or otherwise displaced laterally substantially ahead of the bit tooth. A displaced portion of formation 114 may be removed due to the combined actions of the bit tooth 108 and the engaged impactor 100. The engaged impactor 100 may be skewed laterally and/or downward by force in the bit tooth 108, which may also enlarge the altered zone 124. Excavated formation may include void space 120 plus cross-hatched area 114.

An engaged impactor 100 may be substantially an extension of the bit 60 and may further be substantially an extension of the bit 60 which is advantageously positioned from at least partially below a planar surface 66 of the formation 52 being cut. Under certain angles or incidences of contact, the force applied to a particular impactor 100 may be a substantial portion of the available WOB and/or available torque at the bit 60.

Wherein multiple impactors 100 may be entrained in a formation 52, the mechanical bit tooth-to-impactor and impactor-to-impactor interactions may multiply the effects demonstrated above with a single impactor 100. A plurality of impactors 100 may be engaged simultaneously by one or more bit teeth 108.

The effected formation structural alterations also may enhance expenditure of hydraulic energy at the formation face 66 to hydraulically remove pieces of the formation 52 as cuttings. Impact energy from a respective impactor 100 upon the formation 52 may mechanically create a plurality of micro-fractures 106 or other formation structural alterations in or near the impacted area. Thereby, the effected formation 52 may be more readily exploited by simultaneous hydraulic energy coincident with impactor 100 dynamics. Such enhanced hydraulic action and mechanical alterations to the formation 52 may reduce the work required by bit teeth 108 to both create and remove the formation cuttings, thereby extending bit life while increasing the rate of penetration.

Referring to FIGS. 1 through 5B, this invention includes a method of cutting a subterranean formation 52 using a drilling rig 5, a drill string 55, a fluid pump 2 and/or 4, located substantially at the drilling rig 5, a cutting fluid and plurality of solid material impactors 100. The drill string 55 may include a feed end 210 located substantially near the drilling rig 5 and a nozzle end 215 including a nozzle 64 supported thereon. In an embodiment including a cutting bit 60 interconnected with the drill string, the nozzle end 215 may be a bit end 215 and may include a cutting bit 60 supported thereon. A preferred embodiment may include a drill bit 60 supported on the bit end 215 of the drill string 55, and the drill bit 60 may include at least one nozzle 64 therein.

Although a preferred application of the method may be to drill a well bore 70, the method is not limited to drilling a well bore 70. The method may be applicable to excavating a tunnel, a pipe chase, a mining operation, or other excavation operation wherein earthen material or formation may be cut or drilled for removal. The cutting bit 60 may be a roller cone bit, a fixed cutter bit, an impact bit, a spade bit, a mill, a mining type rock bit, or other implement for cutting rock or earthen formation.

The method may comprise providing the cutting bit 60 with at least one nozzle 64 such that a velocity of the cutting fluid while exiting the cutting bit 60 is substantially greater than a velocity of the cutting fluid while passing through a nominal diameter flow path in the bit end 215 of the drill string 55, such as through drill collars 58.

The cutting fluid may be circulated from the fluid pump 2 and/or 4, such as a positive displacement type mud pump, through one or more drilling fluid conduits 8, 24, 40, 42, into the feed end 210 of the drill string 55. The cutting fluid may also be circulated through the drill string 55 and through the cutting bit 60. The cutting fluid may be pumped at a selected circulation rate and/or a selected pump pressure to achieve a desired impactor and/or drilling fluid energy at the bit 60. The cutting fluid may be a drilling fluid, which is recovered for recirculation in a well bore or the cutting fluid may be a fluid that is substantially not recovered. The cutting fluid may be a liquid, a gas, a foam, a mist or other substantially continuous or multiphase fluid.

The plurality of solid material impactors 100 may be introduced into the cutting fluid to circulate the plurality of solid material impactors 100 with the cutting fluid through the cutting bit 60 and engage the formation 52 with each of the cutting fluid and the plurality of solid material impactors 100.

A cutting fluid or drilling fluid may be pumped at a pressure level and a flow rate level sufficient to satisfy an impactor mass-velocity relationship wherein a substantial portion by weight of the plurality of solid material impactors 100 may create a structurally altered zone 124 in the formation 52. The structurally altered zone 124 may have a structurally altered zone height 132 in a direction perpendicular to a plane of impaction 66 at least two times a mean particle diameter of particles 150 in the formation 52 impacted by the plurality of solid material impactors 100. The mass-velocity relationship may be satisfied as sufficient when a substantial portion by weight of the solid material impactors 100 may by virtue of their mass and velocity at the moment of impact with the formation 100, create a structural alteration as claimed or disclosed herein.

The plurality of solid material impactors 100 may be introduced into the cutting fluid at substantially any convenient location near the drilling rig 5. The drilling rig 5 may be a rig such as for drilling well bores, a tunnel borer, a rock drill for cutting blast holes, or other subterranean excavation apparatus. Substantially concurrent to impactor 100 introduction into the drilling fluid stream that is being circulated to the cutting bit 60, the introduced impactors 100 are also circulated with the drilling fluid to the cutting bit 60. A drill bit 60 may be a cutting bit.

The cutting bit 60 may be rotated while engaging the formation 52 to generate formation cuttings. The cutting fluid may be substantially continuously circulated during drilling operations to circulate at least some of the plurality of solid material impactors 100 and the formation cuttings away from the cutting bit 60 and/or the bit nozzle 64. The impactors and fluid circulated away from the bit 60 and/or nozzle 64 may be circulated substantially back to the drilling rig 5, or circulated to a substantially intermediate position between the drilling rig 5 and the bit 60 and/or nozzle 64. Rotating the cutting bit may also include oscillating the cutting bit 60 rotationally back and forth, and may further include rotating the bit in discrete increments.

Preferably, a majority by weight of the solid material impactors 100 may have a density of at least 230 pounds per cubic foot and a diameter in excess of 0.100 inches. More preferably, the majority by weight of the solid material impactors 100 may have a density of at least 470 pounds per cubic foot and a diameter in excess of 0.100 inches.

As known in the formation drilling and cutting industries, to cut a formation 52, the cutting implement, such as a drill bit 60 or impactor 100, must overcome minimum, in-situ stress levels or toughness of the formation 52. These minimum stress levels are known to typically range from a few thousand pounds per square inch, to in excess of 65,000 pounds per square inch. To fracture, cut or plastically deform a portion of formation 52, force exerted on that portion of the formation 52 typically should exceed the minimum, in-situ stress threshold of the formation 52. The larger the area the force is acts upon, the larger deformation or cutting chip generation may be effected thereby. When an impactor 100 first initiates contact with a formation, the force exerted upon the initial contact point may be much higher than 10,000 pounds per square inch, and may be well in excess of one million pounds per square inch. As the impactor continues to engage the formation 100, the impactor should have sufficient energy to exceed the minimum formation stress threshold and create a structurally altered zone 124 to a depth of in excess of two grain layers into the formation 52, near the impacted area. The impacted area may be an area corresponding to a maximum diameter of a portion of an impactor 100 that engages the formation face 66.

In this invention, a substantial portion by weight of the plurality of solid material impactors 100 may apply at least 5000 pounds per square inch of energy to a formation 52 to create the structurally altered zone 124 in the formation. Further, the impactor 100 may apply in excess of 20,000 pounds per square inch of energy to the formation 52 to create the structurally altered zone 124 in the formation. The structurally altered zone 124 should include a structurally altered height 132 in a direction perpendicular to a plane of impaction 66 at least two times a mean particle diameter of particles 150 in the formation 52 impacted by the plurality of solid material impactors 100. Preferably, the mass-velocity relationship of a substantial portion by weight of the plurality of solid material impactors 100 may provide at least 5000 pounds per square inch of force per area impacted by a respective solid material impactor. A majority by weight of the plurality of solid material impactors 100 preferably have a diameter in excess of 0.100 inches.

More preferably, the mass-velocity relationship of a substantial portion by weight of the plurality of solid material impactors 100 may provide at least 20,000 pounds per square inch of force per area impacted by a respective solid material impactor 100. A majority by weight of the plurality of solid material impactors 100 preferably have a diameter in excess of 0.100 inches.

Even more preferably, the mass-velocity relationship of a substantial portion by weight of the plurality of solid material impactors 100 provide at least 30,000 pounds per square inch of force per area impacted by a respective solid material impactor. A majority by weight of the plurality of solid material impactors 100 preferably have a diameter in excess of 0.100 inches. In each of the above force transfers, a structurally altered zone may be created by a substantial portion by weight of the solid material impactors 100 to create a structurally altered zone 132 to a depth of at least two grain layers deep into the formation 52, near a respective point of impact. Each grain layer may have a height equal to the mean diameter of particles 150 in the formation 52. A substantial portion means at least five percent by weight of the plurality of solid material impactors, and more particularly at least twenty-five percent by weight of the plurality of solid material impactors introduced into the drilling fluid. Even more particularly, substantial portion means at least a majority by weight of the plurality of solid material impactors introduced into the drilling fluid.

A substantial portion by weight of the plurality of solid material impactors 100 may create a structurally altered zone 124 in the formation 52 having a structurally altered zone height 132 in a direction perpendicular to a plane of impaction 66 at least four times a mean particle diameter of particles 150 in the formation 52 impacted by the plurality of solid material impactors 100. More preferably, a substantial portion by weight of the plurality of solid material impactors 100 may create a structurally altered zone 124 in the formation 52 having a structurally altered zone height 132 in a direction perpendicular to a plane of impaction 66 at least eight times a mean particle diameter of particles 150 in the formation 52 impacted by the plurality of solid material impactors 100.

A majority by weight of the solid material impactors 100 may have a velocity of at least 200 feet per second substantially immediately prior to the point at which the impactors 100 engage the formation 52. More preferably, a majority by weight of the solid material impactors 100 may have a velocity of at least 200 feet per second and as great as 1200 feet per second at engagement with the formation 52. Even more preferably, a majority by weight of the solid material impactors 100 may have a velocity of at least 200 feet per second and as great as 750 feet per second at engagement with the formation 52. In an even more preferred embodiment, a majority by weight of the solid material impactors 100 may have a velocity of at least 350 feet per second and as great as 500 feet per second at engagement with the formation 52.

Referring to FIGS. 1 through 5B, this invention may provide a method for cutting a subterranean formation 52 using a drilling rig 5 a drill string 55, a fluid pump 2 located substantially at the drilling rig 5, a cutting fluid and plurality of solid material impactors 100. The drill string 5 may include a feed end 210 located substantially near the drilling rig 5 and a bit end 215 including a cutting bit 60 supported thereon.

The plurality of solid material impactors 100 may be introduced into the cutting fluid to circulate the plurality of solid material impactors 100 with the cutting fluid, through the cutting bit 60 and to engage the formation 52 with both the cutting fluid and the plurality of solid material impactors 100. The plurality of solid material impactors 100 may be introduced into the cutting fluid at substantially any convenient location near the drilling rig 5. The drilling rig 5 may be a rig such as used for drilling well bores, a tunnel borer, a rock drill for cutting blast holes, or other subterranean excavation apparatus or assembly.

A majority by weight of the plurality of solid material impactors 100 may have a mean outer diameter of at least 0.100 inches. Prior art jet cutting and abrasive cutting utilizes particles having a mean diameter of less than 0.100 inches. The cutting bit 60 may be rotated while engaging the formation 52 such that the bit 60 and/or the impactors 100 engaging the formation 52 may generate formation cuttings. The impactors 100 may be introduced into the cutting fluid intermittently during the cutting operation. The rate of impactor 100 introduction relative to the rate of cutting fluid circulation may also be adjusted or interrupted as desired. At least some of the cutting fluid, the plurality of solid material impactors 100 and the formation cuttings may be circulated away from the cutting bit 60 and returned substantially back to the drilling rig 5. "At the drilling rig" shall also include substantially remote separation, such as a separation process that may be at least partially carried out on the sea floor. At the drilling rig 5, at least some of the cuttings and solid material impactors 100 may be separated from at least a portion of the drilling fluid.

The impactors 100 may be introduced into the cutting fluid and circulated with the cutting fluid, through the drill string 55 and drill bit 60 to cause the impactors 100 and the cutting fluid to substantially continuously and repeatedly engage the formation 52. Such engagement with the formation 52 by one or more impactors 100 or with the formation 52 by a bit tooth 108 and an impactor 100, may create a structurally altered zone 124 in the formation 52 having a structurally altered zone height 132 in a direction perpendicular to a plane of impaction 66. The structurally altered zone 124 may have a height of at least two times a mean particle diameter of particles 150 in the formation 52 impacted by the plurality of solid material impactors 100.

Each nozzle 64 in the bit 60 may be selected to provide a desired cutting fluid circulation rate, hydraulic horsepower substantially at the bit 60, and/or impactor energy or velocity at a point of engagement of the respective impactor with the formation. Each nozzle 64 may be selected for inclusion in the bit 60 as a function of at least one of: (a) an expenditure of a selected range of hydraulic horsepower across the one or more bit nozzles 64, (b) a selected range of drilling fluid velocities exiting the one or more bit nozzles 64, and (c) a selected range of solid material impactor 100 velocities exiting the one or more bit nozzles, or engaging the formation 52.

To optimize a cutting rate of penetration, it may be desirable to determine, such as by monitoring, observing, calculating, knowing or assuming one or more drilling parameters such that adjustments may be made in one or more controllable variables in the cutting operation as a function of the determined or monitored drilling parameter. The one or more drilling parameters maybe selected from a group consisting of; (a) a number of teeth 108 on the cutting bit 60 that engage the formation 52 per unit of time, (b) a rate of cutting bit 60 penetration into the formation 52, (c) a depth of cutting bit 60 penetration into the formation 52 from a depth reference point, (d) a formation drillability factor, and (e) a number of solid material impactors 100 introduced into the cutting fluid per unit of time. Monitoring or observing may include monitoring or observing one or more drilling parameters of a group of drilling parameters consisting of a group of; (a) a rate of cutting bit rotation, (b) a rate of cutting bit penetration into the formation, (c) a depth of cutting bit penetration into the formation from a depth reference point, (d) a formation drillability factor, (e) an axial force applied to the cutting bit 60, (f) the selected circulation rate, and/or (g) the selected pump pressure.

One or more controllable drilling or cutting variables or parameters may be altered, including; (a) at least one of a rate of impactor 100 introduction into the drilling fluid, (b) an impactor 100 size, (c) an impactor 100 velocity, (d) a cutting bit nozzle 64 selection, (e) the selected circulation rate of the drilling fluid, (f) the selected pump pressure, and (g) any of the monitored drilling parameters.

The velocity of the plurality of solid material impactors 100 exiting the cutting bit 60 may cause a substantial portion by weight of the plurality of solid material impactors 60 to engage the formation 52 and propagate fractures 116 and/or micro-fractures 106 into the formation 52. Impactor velocity to achieve a desired effect upon a given formation may vary as a function of formation compressive strength, hardness or other rock properties, and as a function of impactor size and cutting fluid rheological properties. In addition to the impactor 100 engaging the formation 52 and altering one or more structural properties therein, a bit tooth 64 or a subsequent impactor 100 may engage an impactor 100 or a portion of the structurally altered zone 124 to further enhance formation structural alteration, the propagation of fractures, or generation of a formation cutting. The velocity of impactors 100 exiting the cutting bit 60 may cause a substantial portion by weight of the impactors 100 to engage the formation 52 and alter the structural properties of the formation 52 to a depth of at least two times the mean diameter of particles 150 in the impacted formation, thereby creating an impactor altered zone 124. More preferably, structural alteration may be effected to a depth of at least one-third the diameter of a majority of the plurality of the solid material impactors 100. Even more preferably, structural alteration may be effected to a depth of at least the diameter of a majority of the plurality of the solid material impactors 100.

A previously impacted solid material impactor 100 and/or the impactor altered zone 124 may be subsequently engaged with another solid material impactor 100 and/or a tooth 108 on the cutting bit 60. Such subsequent engagement may further enlarge and/or structurally alter the structurally altered zone 124, and may also effect extraction of one or more cuttings from the formation 52.

To alter the rate of impactors 100 engaging the formation 52, the rate of impactor introduction into the cutting fluid may be altered. The fluid circulation rate may also be altered independent from the rate of impactor 100 introduction. Thereby, concentration of impactors 100 in the cutting fluid may be adjusted separate from the fluid circulation rate. Introducing a plurality of solid material impactors 100 into the cutting fluid may be a function of impactor size, cutting fluid rate, bit rotational speed, well bore 70 size and a selected impactor engagement rate with the formation 52.

The drilling bit 60 may include a nozzle 64 designed to accommodate impactors 100, such as an especially hardened nozzle, a shaped nozzle, or an "impactor" nozzle, which may be particularly adapted to a particular application. The nozzle 64 is preferably a type that is known and commonly available. The nozzle 64 may further be selected to accommodate impactors 100 in a selected size range or of a selected material composition. Nozzle size, type, material and quantity may be a function of the formation being cut, fluid properties, impactor properties and/or desired hydraulic energy expenditure at the nozzle 64. The nozzle 64 may be of a dual-discharge nozzle, such as the dual jet nozzle taught in U.S. Pat. No. 5,862,871. Such dual discharge nozzles may generate each of (1) a radially outer drilling fluid jet substantially encircling a jet axis, and (2) an axial drilling fluid jet substantially aligned with and coaxial with the jet axis, and the dual discharge nozzle directing a majority by weight of the plurality of solid material impactors into the axial drilling fluid jet. A dual discharge nozzle 64 may separate a first portion of the drilling fluid flowing through the nozzle 64 into a first drilling fluid stream having a first drilling fluid exit nozzle velocity, and a second portion of the drilling fluid flowing through the nozzle 64 into a second drilling fluid stream having a second drilling fluid exit nozzle velocity lower than the first drilling fluid exit nozzle velocity. The plurality of solid material impactors 100 may be directed into the first cutting fluid stream such that a velocity of the plurality of solid material impactors 100 while exiting the drill bit 60 is substantially greater than a velocity of the cutting fluid while passing through a nominal diameter flow path in the bit end 215 of the drill string 55, to accelerate the plurality of solid material impactors 100.

In a preferred embodiment, the impactors 100 may be substantially spherical and metallic, such as steel shot, and a majority by weight of the introduced impactors 100 may have a mean outer diameter in excess of 0.100 inches. Impactor diameter may be selected at least partially as a function of one or more monitored formation cutting parameters.

Introducing the impactors 100 into the drilling fluid may be accomplished by any of several known techniques, such as preferably pumping the impactors with progressive cavity pump. The solid material impactors 100 also may be introduced into the drilling fluid by withdrawing the plurality of solid material impactors 100 from a low pressure impactor source 98 into a high velocity stream of cutting fluid, such as by venturi effect.

Referring to FIGS. 1 through 5B, this invention includes methods for cutting a formation 52 and more particularly for drilling a wellbore 70 through a subterranean formation 52 using a drilling rig 5, a drill string 55, a fluid pump 2 and/or 4 located substantially at the drilling rig 5, and a drilling fluid. The drill string 55 may include an upper end located substantially near the drilling rig 5 and a bit end 215 including a drill bit 60 supported thereon. A preferred method may include the steps described previously for cutting a formation, and including providing a plurality of solid material impactors 100.

A drill bit 60 may be provided with at least one nozzle 64 and more preferably three nozzles 64, such that a velocity of the drilling fluid while exiting the drill bit 60 is substantially greater than a velocity of the drilling fluid while passing through a nominal diameter flow path in the bit end 215 of the drill string, such as in a drill collar 58.

The plurality of solid material impactors 100 may be provided substantially adjacent the drilling rig, such as in a storage bin 82, and including a pump or other method for introducing the impactors into the circulating drilling fluid stream. Drilling fluid may be circulated from the fluid pump 2 and/or 4, into the upper end of the drill string 55, through the drill string 55 and through the drill bit 60, the drilling fluid being pumped at at least one of a selected circulation rate and a selected pump pressure. The drilling fluid may also be provided with rheological properties sufficient to adequately transport and/or suspend the plurality of solid material impactors 100 within the drilling fluid.

The plurality of solid material impactors may be introduced into the drilling fluid at a selected introduction rate and/or concentration to circulate the plurality of solid material impactors 100 with the drilling fluid through the drill bit 60. The selected circulation rate and/or pump pressure, and nozzle selection may be sufficient to expend a desired portion of energy or hydraulic horsepower in each of the drilling fluid and the impactors 100. The formation 52 may be engaged or impacted with each of the drilling fluid and the plurality of solid material impactors.

A majority by weight of the plurality of solid material impactors preferably have a mean outer diameter in excess of 0.100 inches. The bit 60 may be rotated while circulating the drilling fluid and engaging the plurality of solid material impactors 100 substantially continuously or selectively intermittently, with the a bottom hole surface 66 ahead of the drill bit 60. In a preferred embodiment, the nozzles 64 maybe oriented to cause the solid material impactors 100 to engage the formation 52 with a radially outer portion of the bottom hole surface 66. Thereby, as the drill bit 60 is rotated one or more circumferential kerf may be created by the impactors 100, in the bottom hole surface 66 ahead of the bit 60. The drill bit 60 may thereby generate formation cuttings more efficiently due to reduced stress in the surface 66 being drilled, due to the one or more substantially circumferential kerfs in the surface 66.

After engaging the formation 52, at least some of the drilling fluid, the plurality of solid material impactors 100 and the generated formation cuttings may be circulated substantially back to the drilling rig 5. At the drilling rig, the returned cuttings and solid material impactors 100 may be separated from the drilling fluid to salvage the drilling fluid for recirculation of the drilling fluid into the present well bore 70 or another well bore. At least a portion of the impactors 100 may be separated from a portion of the cuttings by a series of screening devices, such as the vibrating classifiers 84 discussed previously, to salvage a reusable portion of the impactors 100 for reuse to re-engage the formation 52. A majority of the cuttings and a majority of non-reusable impactors may be discarded.

In a preferred embodiment, a progressive cavity type pump 96 may be utilized to pump the slurry of drilling fluid and solid material impactors 100 into the drilling fluid stream pumped by the mud pump 2 and/or 4. An impactor slurry injector head 34 may be provided on the gooseneck 36, which may be located atop the swivel 28. A port 30 may be provided in the gooseneck 36 to permit the introduction of the plurality of solid material impactors 100 into the drilling fluid through the injector head 34. A low volume, medium pressure mud pump 4 may also introduce a stream of drilling fluid into the gooseneck 36, through the injector head 34.

A majority by weight of the introduced plurality of solid material impactors 100 preferably may be substantially spherically shaped and include an outer diameter of at least 0.100 inches. More preferably a majority by weight of the impactors 100 may have a diameter of at least 0.125 inches and as great as 0.333 inches. Even more preferably, a majority by weight of the impactors 100 may have a diameter of at least 0.150 inches and as great as 0.250 inches.

The velocity of a majority by weight of the plurality of solid material impactors immediately exiting a drill bit nozzle 64 may be as slow as 250 feet per second and as fast as 1000 feet per second, immediately upon exiting the nozzle. The velocity of a majority by weight of the impactors 100 may be substantially the same, only slightly reduced, at the point of impact of an impactor 100 at the formation surface 66.

Referring to FIGS. 1 through 5B, a method is provided for cutting a subterranean formation 52 using a drilling rig 5, a drill string 55, at least one fluid pump 2 and/or 4 located substantially at the drilling rig 5 and a cutting fluid. The drill string 55 may include a feed end 210 located substantially near the drilling rig 5 and a bit end 215 including a cutting bit 60 supported thereon. The method may be similar to the previously discussed methods for cutting a subterranean formation or methods for drilling a well 70 and may include creating a structurally altered zone 124 in the formation 52. The formation 52 may be engaged by the cutting fluid and the plurality of solid material impactors 100 to create a structurally altered zone 124 in the formation 52 having a structurally altered height 132 in a direction perpendicular to a plane of impaction 66 at least two times a mean particle diameter of particles 150 in the formation 52 impacted by the plurality of solid material impactors 100. It should be understood that each impactor 100 will have its own plane of impaction 66 with the formation 52.

A majority by weight of the plurality of solid material impactors 100 may have an impactor diameter of at least 0.100 inches. The structurally altered zone 124 may include a fracture 116 in the formation having a fracture height at least two times a mean particle diameter of particles 150 in the impacted formation 52 in a direction perpendicular to a plane of impaction 66. More preferably, at least one fracture 116 may be created in the formation 52 having a fracture height 132 at least four times a mean particle diameter of particles 150 in the impacted formation. Even more preferably, at least one fracture 116 may be created in the formation 52 having a fracture height 132 at least eight times a mean particle diameter of particles 150 in the impacted formation 52.

The structurally altered zone 124 may include a compressive spike 102, which may be more dense than the adjacent formation 52 and/or may be thermally altered due to impact energy. The compressive spike 102 may include a spike length 134 at least two times a mean particle diameter of particles 150 in the formation 52.

At least one of a circulation rate and a pump pressure may be selected such that the momentum of at least five percent by weight of the plurality of solid material impactors 100 at a point of impact with the formation 52 may create a plurality of fractures 116 in the formation 52 each having a fracture length at least two times a mean particle diameter of particles 150 in the impacted formation 52.

Introducing the plurality of solid material impactors 100 into the cutting fluid may cause a substantial portion by weight of the introduced impactors to engage the formation 52 and alter one or more structural rock properties of the formation 52 in the vicinity a respective point of impact. Such alteration may include altering the density of or creating a fracture in, at least a portion of the formation in the vicinity of a respective point of impact.

Introducing the plurality of solid material impactors 100 into the cutting fluid may cause a first impactor 100 to engage the formation. Subsequently, at least one additional impactor may engage the first impactor 100 thereby causing at least one of the first impactor 100 and the at least one additional impactor to alter the structural rock properties of the formation 52 in the vicinity of at least one of the first impactor 100 and the at least one additional impactor. In addition, rotating the cutting bit 60 may cause at least one tooth 108 on the cutting bit 60 to engage at least one solid material impactor 100, causing the at least one solid material impactor 100 to alter the structural rock properties of the formation 52.

Referring to FIGS. 1 through 5B, this invention provides a system for cutting a subterranean formation 52 using a drilling rig 5, a drilling fluid pumped into a well bore 70 by fluid pump(s) 2 and/or 4 located at the drilling rig 5. A drill string 55 is included having a feed end 210 located substantially near the drilling rig 5, a bit end 215 for supporting a drill bit 60, and including at least one through bore to conduct the drilling fluid substantially between the drilling rig 5 and the drill bit 60. The drill bit 60 includes at least one nozzle 64 at least partially housed in the drill bit 60 such that a velocity of the drilling fluid while exiting the drill bit 60 is substantially greater than a velocity of the drilling fluid while passing through a nominal diameter of the through bore in the bit end 215 of the drill string 55.

An impactor introducer 96 may be included to pump or introduce a plurality of solid material impactors 100 into the drilling fluid before circulating a plurality of impactors 100 and the drilling fluid to the drill bit 60. In a preferred embodiment, the impactor introducer 96 may be a progressive cavity pump.

The plurality of solid material impactors 100 may be included for engaging the formation 52. The plurality of solid material impactors may be composed of distinct, separate, independent impactors. Preferably, the impactors 100 may be substantially spherically shaped and composed of a substantially metallic material, such as steel shot. A majority by weight of the impactors 100 may include an outer diameter of at least 0.100 inches. More preferably, a majority by weight of the impactors 100 may be at least 0.125 inches in diameter and may be as large as 0.333 inches in mean diameter. Even more preferably, a majority by weight of the impactors 100 may be at least 0.150 inches in mean diameter and may be as large as 0.250 inches in mean diameter.

A preferred system may also include an impactor introducer conduit 88, 38 for conducting the plurality of solid material impactors 100 from an impactor introducer 96 substantially to the feed end 210 of the drill string 55. The system may also include a fluid conduit 8, 24, 40, 42 for conducting the drilling fluid from the drilling fluid pump 4, 2 substantially to the feed end 210 of the drill string 55. The fluid conduit 8, 24, 40, 42 may include at least one introduction port 30 for introducing the plurality of solid impactors 100 from the impactor introducer 96 into the drilling fluid.

The system for cutting a subterranean formation using a drilling rig may include a gooseneck 36 having a through bore therein for conducting drilling fluid from at least one of the fluid conduits 8, 24, 40, 42 to a drilling swivel 28. The gooseneck 36 may include the introduction port 30 in the gooseneck. The drilling swivel 36 including the through bore for conducting drilling fluid therein, may be substantially supported on the feed end 210 of the drill string 55 for conducting drilling fluid from the goose neck into the feed end 210 of the drill string. The feed end 210 of the drill string 55 may include a kelly 50 to connect the drill pipe 56 with the swivel quill 26 and/or the swivel 28.

The system may further comprise a drilling fluid separator system, such as discussed previously in reference to FIG. 1, which may include a reclamation tube 44 to separate a portion of the circulated impactors 100 and a portion of the cuttings from a portion of the drilling fluid. A vibrating classifier 84, may also be included to reclaim a reusable portion of impactors 100 for recirculation or reuse. An impactor storage tank 94 may receive the reclaimed portion of impactors 100. A slurrification tank 98 may receive impactors 100 from the storage tank 94 and a portion of drilling fluid, in order to create a slurry containing a selected concentration of impactors to be introduced into a pumped portion of drilling fluid and circulated into the wellbore 70. A portion of the drilling fluid may be recovered into a mud tank 8 for recirculation into the well bore 70.

An alternative embodiment of this invention may include cutting a formation using a plurality of solid material impactors to engage the formation, in the absence of a cutting bit engaging the formation. A nozzle 64 may be provided on a nozzle end 215 of the drill string 55. The nozzle may be rotated, maintained rotationally substantially stationary, and/or oscillated rotationally back and forth, to direct the plurality of solid material impactors and/or the drilling fluid into engagement with the formation 52.

The method may comprise providing at least one nozzle 64 such that a velocity of the cutting fluid while exiting the nozzle 64 is substantially greater than a velocity of the cutting fluid while passing through a nominal diameter flow path in the nozzle end 215 of the drill string 55.

The cutting fluid may be circulated from the fluid pump 2 and/or 4, such as a positive displacement type mud pump, through one or more drilling fluid conduits 8, 24, 40, 42, into the feed end 210 of the drill string 55. The cutting fluid also may be circulated through the drill string 55 and through the cutting bit 60. The cutting fluid may be pumped at a selected circulation rate and/or a selected pump pressure to achieve a desired impactor and/or drilling fluid energy at the nozzle 64. The cutting fluid may be a drilling fluid, which is recovered for recirculation in a well bore or the cutting fluid may be a fluid, which is substantially not recovered for reuse or recirculation. The cutting fluid may be a liquid, a gas, a foam, a mist or other substantially continuous or multiphase fluid.

The plurality of solid material impactors 100 may be introduced into the cutting fluid to circulate the plurality of solid material impactors 100 with the cutting fluid through the nozzle 64 and engage the formation 52 with each of the cutting fluid and a majority by weight of the plurality of solid material impactors 100.

A cutting fluid or drilling fluid may be pumped at a pressure level and a flow rate level sufficient to satisfy an impactor mass-velocity relationship wherein a substantial portion by weight of the majority by weight of the plurality of solid material impactors 100 that engage the formation 52 may create a structurally altered zone 124 in the formation 52. The structurally altered zone 124 may have a structurally altered zone height 132 in a direction perpendicular to a plane of impaction 66 at least two times a mean particle diameter of particles 150 in the formation 52 impacted by the plurality of solid material impactors 100. The mass-velocity relationship may be satisfied as sufficient when a substantial portion by weight of the solid material impactors 100 may by virtue of their mass and velocity at the moment of impact with the formation 100, create a structural alteration as claimed and/or disclosed herein.

The plurality of solid material impactors 100 may be introduced into the cutting fluid at substantially any convenient location near the drilling rig 5. The drilling rig 5 may be a rig such as for drilling well bores, a tunnel borer, a rock drill for cutting blast holes, or other subterranean excavation apparatus. Substantially concurrent to impactor 100 introduction into the drilling fluid stream that is being circulated to the nozzle 64, the introduced impactors 100 also may be circulated with the drilling fluid to the nozzle 64.

Other alternative embodiments may include an impactor introducer that creates a venturi effect for withdrawing a portion of the plurality of solid material impactors 100 from an impactor source vessel, such as a slurrification tank, an impactor storage tank or an impactor storage bin. The venturi type impactor venturi inductor thereby may withdraw a plurality of solid material impactors 100 into a high velocity stream of fluid, such as drilling fluid, and subsequently introduce the impactors 100 and fluid into the circulated drilling fluid.

In still other alternative embodiments, the system may include a pump, such as a centrifugal pump, having a resilient lining that is compatible for pumping a solid-material laden slurry. The pump may pressurize the slurry to a pressure greater than the selected mud pump pressure to pump the plurality of solid material impactors into the drilling fluid. The impactors may be introduced through an impactor injection port, such as port 30. Other alternative embodiments for the system may include an impactor injector including an auger for introducing the plurality of solid material impactors 100 into the drilling fluid.

Alternative embodiments of impactors may include other metallic materials, including tungsten carbide, copper, iron, or various combinations or alloys of these and other metallic compounds. Impactors may also be composed of non-metallic materials, such as bauxite, ceramics or other man-made or substantially naturally occurring non-metallic materials. Other alternative embodiments may include impactors that may be crystalline shaped, angular shaped, sub-angular shaped, particularly shaped, such as like a torpedo, dart, rectangular, or otherwise generally non-spherically shaped.

In alternative embodiments, a majority by weight of the plurality of solid material impactors may be substantially rounded and have a non-uniform outer diameter. Other alternative embodiments may include impactors in which a majority by weight of the impactors may be substantially crystalline or irregularly shaped. In such alternative embodiments, a majority by weight of the impactors may be of a substantially uniform mass, grading or size. At least one length or diameter dimension may be at least 0.100 inches.

In alternative embodiments of the methods of this invention, the structurally altered zone 124 may include a fracture 116 in the formation having a fracture height 132 of at least two times a mean diameter of a majority by weight of the plurality of solid material impactors 100 impacting the formation 52, in a direction perpendicular to the plane of impaction 66. Fractures 116 also may be created in formations that may be susceptible to fracturing, which have a fracture length in excess of eight time a mean diameter of a majority by weight of the plurality of solid material impactors.

As the plurality of solid material impactors 100 exiting the cutting bit 60 engage the formation 52, a substantial portion by weight of the plurality of solid material impactors 100 may create a plurality of craters 120 in the formation. Each of the plurality of craters 120 may have a crater depth 109 of at least one-third the diameter of the respective impactor 100 that created the respective crater 109.

As discussed previously, several theories and mechanisms are advanced to explain and support the surprisingly good results obtained using the methods and systems of this invention in cutting subterranean formations. A mechanism that may be at least partially responsible for the successful application of this invention in certain formations 52, such as deep, relatively hard to conventionally drill formations, is shot peening. The mechanism and methods of shot peening are well known in the metals arts to render a hardened or toughened surface. In the formation cutting or drilling industry, the adaptation of these techniques has not heretofore been established as pertains to rock formations. Some understanding of the mechanics of formation drilling may help to enable a drill bit designer, a nozzle designer, a drill bit user, nozzle user and user of the methods of this invention each to increase the performance of formation cutting or drilling equipment and techniques.

When a rock formation is subjected to years of pressure and stress deformations from above, beneath and laterally, in conjunction with exposure to elevated temperature, and leaching or permeating chemicals, the rock formation may undergo substantial changes. The resulting formation may have properties ranging from a soft powder to near diamond hard obsidian, or an agglomeration of properties, depending upon the initial rock properties and exposed conditions. For example, extremely hard stone chips can be imbedded in relatively soft limestone or shale. The results may be formations with varying parameters of porosity, hardness, permeation, lubricity, size, and thickness and a substantially heterogeneous mixture or series of formation layers. The general works of public knowledge include a diverse and in depth description of those parameters and additional related material, such that by reason of commonness they are included herein by reference.

The drilling of bore holes such as well bores for oil and gas production may require drilling through a sequence of varied formation types to excavate the borehole. The formations generally include inherent strength thresholds, hardness, and abrasive characteristics that must be overcome by the mechanical action of the drill bit and drilling fluids during drilling to generate chips of cuttings. The cuttings may be subsequently removed to the surface by hydraulic transportation by the circulating drilling fluid. The drilling fluid typically circulates to the bit through interior passages in the drill string and the drill bit, wherein the fluid may be accelerated by through one or more drill bit nozzles. After exiting the nozzles, the fluid may be impinged against and in some circumstances ideally at least partially into formation being drilled and returned to the surface via the annular space between the drill string and the well bore wall.

These earthen formations may be subject to increasing overburden and in situ stress forces as a function of increasing depth. The bit teeth and hydraulic drilling fluid forces acting on the formation may generally tend to "work harden" or toughen the formation, which may make the formation more resistant to chip generation by the mechanical action of the drill bit.

When a relatively high mass impactor 100, as opposed to an abrasive type particle, is accelerated to a selected velocity and impacted against a formation 52, one or more of several things may occur at or near the point of impact:

1. An impactor 100 may simply impart a portion of its kinetic energy into the rock, bounce off, be disintegrated or any combination thereof. Such occurrence may result when the momentum (Momentum=mass×velocity) or the total impact force (Force=mass×acceleration) of the impactor 100 at the point of impact with the formation 52 may be less than the resistive physical properties of the rock. At least some of the energy may be dissipated as heat in an elastic and/or plastic deformation of the substantially immovable formation surface.
2. An impactor 100 may penetrate a small distance into the formation 52 and cause the displaced or structurally altered rock to "splay out" or be reduced to small enough particles for the particles to be removed or washed away by hydraulic action. Hydraulic particle removal may depend at least partially upon available hydraulic horsepower and at least partially upon particle wet-ability and viscosity. Such formation deformation may be a basis for work hardening of a formation by "impactor peening," as the plurality of solid material impactors 100 may displace formation material back and forth. Such working of the formation may equalize compressive force irregularities near the formation surface 66.
3. An impactor 100 may be driven relatively deep into the formation and may cause compressive and/or shear related fractures or micro-fractures in the formation and possibly even some localized melting. The melting mechanism may be similar to what sometimes happens to bullet-type "perforators," which are often composed of tungsten or other very high-density materials.
4. An impactor 100 may actually be at least partially melted and may expend a portion of its energy creating a fracture 116 or indentation 120 in the formation 52, and may move a tiny compressive spike 102 inside the formation 52 along a propagation path 130 ahead of and in the direction of impactor engagement with the plane of impaction 66. In creating a spike and/or subsequently displacing a previously created spike, it may be important to understand that ahead of an impactor 100, a compression zone may exist such that the forces may be acting in the formation, away from and centered upon the point of impact, based upon a root means squared distribution of impacting forces. Such force distribution may be at least partially influenced by homogeneity of the formation and densities of various components thereof. It may not be necessary for the relatively higher density spike, such as spike 102, to be melted into a new form of rock. Rather, the levels of compression and structural rock matrix alteration may effect a change in rock density in the spike, which in turn may subsequently beneficially act as if the spike were substantially as hard or dense as the impactor. The density change in the spike may extend into the formation for a spike length 134, which may be in excess of four times the diameter of the respective impactor. Various combinations of the above effects may be predictable in certain formations. Such thermo-mechanical effects in formations may be similar to effects observed or produced in the military by "penetrator munitions." A brief simplification may be stated such that compression causes heating and heating causes melting and the point of maximum compression is generally at the center of area of impact.

As discussed above, a number of structural alterations or effects which may improve rate of penetration during formation cutting or drilling may be mechanically imposed upon a formation 52 by methods and/or systems employing impactors 100. Some of the imposed effects may include; (a) creation of a work hardened and/or less-plastic formation face 66 ahead of the bit 60, and (b) the creation of compression spikes 102 in the formation 52 ahead of an impactor, wherein the spike may have an increased density.

Another effect, shot peening, is well known in the metals arts and an understanding of the same or similar characteristics and methods may be beneficially applied to the impactor methods and systems of this invention to enhance the drillability of formations. Formation peening and/or work hardening of a formation 52, including creation of a density spike 102, fracture 116 or both, by impact mechanics and/or by the mechanical interaction between a bit tooth 108 and/or an impactor 100, and the formation 52 may facilitate improved rate of penetration.

When an impactor 100 is embedded or entrained into the formation 52, even briefly, the impactor 100 may be subsequently engaged by a bit tooth 108. Thereby, the impactor 100 may transmit at least a portion of each of a compressive (WOB) and/or lateral (rotational) loads as a portion of each of the total WOB and total torque on the bit 60, through the impactor 100 and into a spike 102, a fracture 116, and/or laterally into the formation 52 along natural cleavage planes (not shown). Engaged impactors 100 may act as a lever or torque extender. Such engagement may act to lift or shear cutting chips from the formation 52, as opposed to the conventional bit tooth cutting or compressing mechanism for cutting chip generation. In addition, such effects may be transmitted by engaging a single impactor 100 or a stack of impactors 100 imbedded within the formation 52. Thereby at least a portion of the WOB and rotational forces in bit tooth 108 and/or the hydraulic forces may be directed laterally or otherwise in one or more various directions through the formation 52. Thereby, natural formation weaknesses, cleavage planes and directions of least resistive stress may be exploited mechanically and/or hydraulically to effect enhanced cutting generation and improved rate of penetration. In addition, the work hardened zone may also be more receptive to subsequent fracturing or cutting extraction than the structurally unaltered formation.

The plastic yield stress value and compressive strength of the impactor preferably should be greater than the strength of the formation 52 and less than that of the bit tooth 108 and/or bit cone 62. If the impactor has a lower compressive or yield strength than the formation the impactor will likely be destroyed or damaged instead of structurally altering or penetrating the formation 52.

In addition, the number of impactors 100 "on bottom" at any given time may be relevant to the hardness and drillability of the formation 52, in optimizing the rate of penetration by the bit 60. If the formation 52 is relatively hard and/or is responsive to the creation of fractures 116 or cavities 120, the number of impactors 100 engaging the formation per unit of time, or available for positioning the impactors 100 between the bit teeth 108 and formation 52, may be relatively low for a given well bore diameter. For the same well bore diameter, if the formation 52 is relatively brittle more impactors 100 may be required to engage the formation per the same unit of time, to optimize the rate of penetration. If the formation 52 is relatively soft, pliable, plastic-like or gummy, an even greater number or concentration of impactors may be required to engage the formation 52 over the same time unit to optimize rate of penetration in the formation 52. A relatively soft or gummy formation may benefit from an increase in the concentration of impactors by creating a more drillable formation consistency, which may be less prone to bit balling.

However, in most formations, too many impactors 100 engaging the formation per time unit may be detrimental to optimizing the rate of penetration. An optimum point may be reached where the number of impactors engaging the formation or available for positioning between the formation 52 and bit teeth 108 may optimize rate of penetration. A concentration above this point may adversely effect rate of penetration by adversely effecting performance of the impactors 100 and/or the bit 60.

A relationship for approximating the required number of impactors in a particular well bore size and bit type may be considered. For example, if a 4¾" bit has approximately 8 to 15 teeth engaged with the formation face 66 at any instant of time and is rotated at 150 rpm, there may be approximately 3600 to 6750 teeth per minute striking the formation face 66. Each tooth has a tooth area based on its shape which may engage the formation face 66. A bit tooth having a substantially flat surface which is substantially parallel to the plane of impaction 66 may strike an impactor and may transfer substantially a substantial portion of the WOB and/or rotational force to the impactor, thereby creating a resultant line of action or force through the respective impactor. If the tooth surface is curved, the engaged force transmitted to the impactor may be along a different result line, which may be more perpendicular or angular to the plane of impaction 66 than the flat tooth resultant. The WOB and rotational forces in the bit 60 may be apportioned among the teeth 108 engaged with the formation and/or impactors 100. The fewer the number of teeth 108 and/or impactors engaged by teeth, the more force may be applied to each respective engaged impactor 100 and/or structurally altered zone 124. Fractures 116 and/or structural alteration may be imparted into even very hard or tough formations.

Engaging impactors 100 with a formation 52 at almost any angle of impact 130 may be beneficial to increasing rate of penetration, as the mere presence of impactors for the bit teeth 108 to engage may structurally alter the formation in a manner which increases drillability by the bit 60. Thereby, in certain formations, impactor concentration may be more beneficial to improving rate of penetration by the bit 60, than the impactor penetration depth into the formation due to the impact energy.

A practical range of impactor rate of introduction into the drilling fluid may be from 30 thousand to 300 thousand impactors per minute. As a guideline for improved rate of penetration in many formations, an optimal concentration of impactors may be reached when the ratio of impactors to bit teeth engaging the formation at any instant of time is about 10:1 for relatively hard rock drilling, and higher for softer formations. The ratio may be lower for extremely hard formations. In addition, harder formations may respond better to relatively smaller size impactors, while softer formations may respond better to relatively larger size impactors. The aerial distribution of impactors across the formation face 66 at the bottom of a well bore 70 may be up to 80% of the bottom hole area for soft formations and as little as 20% for hard formations. In hard formations, the strength and shape of the impactors may also be considered.

A broad theme of this invention is creating a mass-velocity relationship in each of a plurality of solid material impactors 100 transported in a fluid system, such that a substantial portion by weight of the impactors 100 may each have sufficient energy to structurally alter a portion of a targeted formation 52 in the vicinity of a point of impact. Preferably, the structurally altered zone 124 may be altered to a depth 132 of at least two times the mean diameter of the particles 150 in the formation 52. Impactor shape is preferably spherical, however other shapes may be used in alternative embodiments. If an impactor 100 is of a specific shape such as that of a dart, a tapered conic, a rhombic, an octahedral, or similar oblong shape, a reduced impact area to impactor mass ratio may be achieved. The shape of a majority by weight of the impactors may be altered, so long as the mass-velocity relationship remains sufficient to create a claimed structural alteration in the formation and an impactor has at least one length or diameter dimension in excess of 0.100 inches. Thereby, a velocity required to achieve a specific structural alteration may be reduced as compared to achieving a similar structural alteration by impactor shapes having a higher impact area to mass ratio. Shaped impactors may be formed to substantially align themselves along a flow path, which may reduce variations in the angle of incidence between the impactor 100 and the formation 52. Such impactor shapes may also reduce impactor contact with the flow structures such those in the drill string 55 and drilling rig 5 and may thereby minimize abrasive erosion of flow conduits.

A variation on that broad theme may include inputting pulses of energy in the fluid system sufficient to impart a portion of the input energy in an impactor 100. The impactor 100 may thereby engage the formation 52 with sufficient energy to achieve a structurally altered zone 124 having a structurally altered height 132 of at least two times the diameter of the particles 150 in the formation 52. Pulsing of the pressure of the fluid in the drill string 55, near the bit 60 also may enhance the ability of the drilling fluid to generate cuttings subsequent to impactor 100 engagement with the formation 52. Pulsing or otherwise energizing impactors 100 in a fluid based formation cutting or drilling system remains within the scope of this invention.

Each combination of formation type, bore hole size, bore hole depth, available weight on bit, bit rotational speed, pump rate, hydrostatic balance, drilling fluid rheology, bit type and tooth/cutter dimensions may create many combinations of optimum impactor presence or concentration, and impactor energy requirements. The methods and systems of this invention facilitate adjusting impactor size, mass, introduction rate, drilling fluid rate and/or pump pressure, and other adjustable or controllable variables to determine and maintain an optimum combination of variables. The methods and systems of this invention also may be coupled with select bit nozzles, downhole tools, and fluid circulating and processing equipment to effect many variations in which to optimize rate of penetration.

It may be appreciated that various changes to the details of the illustrated embodiments and systems disclosed herein, may be made without departing from the spirit of the invention. While preferred and alternative embodiments of the present invention have been described and illustrated in detail, it is apparent that still further modifications and adaptations of the preferred and alternative embodiments will occur to those skilled in the art. However, it is to be expressly understood that such modifications and adaptations are within the spirit and scope of the present invention, which is set forth in the following claims.

We claim:

1. A method of drilling a subterranean formation using a drilling rig, a drill string, a fluid pump located substantially at the drilling rig, a drilling fluid and plurality of solid material impactors, the drill string including a feed end located substantially near the drilling rig and a nozzle end including a nozzle supported thereon, the method comprising:

providing at least one nozzle such that a velocity of the drilling fluid while exiting the nozzle is substantially greater than a velocity of the drilling fluid while passing through a nominal diameter flow path in the nozzle end of the drill string;

introducing the plurality of solid material impactors into the drilling fluid to circulate the plurality of solid material impactors with the drilling fluid into the feed end of the drill string, through the drill string and through the nozzle, the drilling fluid being pumped at at least one of a selected circulation rate and a selected pump pressure;

pumping the drilling fluid at a pressure level and a flow rate level sufficient to satisfy an impactor mass-velocity relationship wherein a substantial portion by weight of the plurality of solid material impactors creates a structurally altered zone in the formation having a structurally altered zone height in a direction perpendicular to a plane of impaction at least two times a mean particle diameter of particles in the formation impacted by the plurality of solid material impactors;

circulating at least some of the drilling fluid, the plurality of solid material impactors and the formation cuttings away from the at least one nozzle.

2. The method of drilling a subterranean formation as defined in claim 1, further comprising:

rotating the nozzle while engaging the formation to generate formation cuttings.

3. The method of drilling a subterranean formation as defined in claim 1, wherein a substantial portion by weight of the solid material impactors have a velocity of at least 200 feet per second at engagement with the formation.

4. The method of drilling a subterranean formation as defined in claim 1, wherein a substantial portion by weight of the solid material impactors have a velocity of at least 200 feet per second and as great as 1200 feet per second at engagement with the formation.

5. The method of drilling a subterranean formation as defined in claim 1, wherein a substantial portion by weight of the solid material impactors have a velocity of at least 200 feet per second and as great as 750 feet per second at engagement with the formation.

6. The method of drilling a subterranean formation as defined in claim 1, wherein a substantial portion by weight of the solid material impactors have a velocity of at least 350 feet per second and as great as 500 feet per second at engagement with the formation.

7. The method of drilling a subterranean formation as defined in claim 1, wherein a substantial portion by weight of the solid material impactors have a density of at least 230 pounds per cubic foot and a diameter in excess of 0.100 inches.

8. The method of drilling a subterranean formation as defined in claim 1, wherein a substantial portion by weight of the solid material impactors have a density of at least 470 pounds per cubic foot and a diameter in excess of 0.100 inches.

9. The method of drilling a subterranean formation as defined in claim 1, wherein the mass-velocity relationship of a substantial portion of the plurality of solid material impactors provides at least 5000 pounds per square inch of force per area impacted by a respective solid material impactor having a mean diameter in excess of 0.100 inches.

10. The method of drilling a subterranean formation as defined in claim 1, wherein the mass-velocity relationship of a substantial portion of the plurality of solid material impactors provides at least 20,000 pounds per square inch of force per area impacted by a respective solid material impactor having a mean diameter in excess of 0.100 inches.

11. The method of drilling a subterranean formation as defined in claim 1, wherein the mass-velocity relationship of a substantial portion of the plurality of solid material impactors provides at least 30,000 pounds per square inch of force per area impacted by a respective solid material impactor having a mean diameter in excess of 0.100 inches.

12. The method of drilling a subterranean formation as defined in claim 1, wherein a substantial portion by weight of the plurality of solid material impactors create a structurally altered zone in the formation having a structurally altered zone height in a direction perpendicular to a plane of impaction at least four times a mean particle diameter of particles in the formation impacted by the plurality of solid material impactors.

13. The method of drilling a subterranean formation as defined in claim 1, wherein a substantial portion by weight of the plurality of solid material impactors create a structurally altered zone in the formation having a structurally altered zone height in a direction perpendicular to a plane of impaction at least eight times a mean particle diameter of particles in the formation impacted by the plurality of solid material impactors.

14. A method of drilling a subterranean formation using a drilling rig, a drill string, a fluid pump located substantially at the drilling rig, a drilling fluid and plurality of solid material impactors, the drill string including a feed end located substantially near the drilling rig and a bit end including a drilling bit supported thereon, the method comprising:

providing the drilling bit with at least one nozzle such that a velocity of the drilling fluid while exiting the drilling bit is substantially greater than a velocity of the drilling fluid while passing through a nominal diameter flow path in the bit end of the drill string;

introducing the plurality of solid material impactors into the drilling fluid to circulate the plurality of solid material impactors with the drilling fluid through the drilling bit, the drilling fluid being pumped at at least one of a selected circulation rate and a selected pump pressure, a substantial portion by weight of the plurality of solid material impactors each having a mean diameter in excess of 0.100 inches;

rotating the drilling bit while engaging the formation to generate formation cuttings; and circulating at least some of the drilling fluid, the plurality of solid material impactors and the formation cuttings away from the at least one nozzle.

15. The method of drilling a subterranean formation as defined in claim 14, further comprising:

introducing the plurality of solid material impactors into the drilling fluid to circulate the plurality of solid material impactors with the drilling fluid through the drilling bit and engage the formation with both the drilling fluid and the plurality of solid material impactors;

pumping the drilling fluid at a pressure level and a flow rate to create a structurally altered zone in the formation having a structurally altered zone height in a direction perpendicular to a plane of impaction at least two times a mean particle diameter of particles in the formation impacted by the plurality of solid material impactors.

16. The method of drilling a subterranean formation as defined in claim 14, further comprising:

selecting each of the at least one nozzles for inclusion in the bit as a function of at least one of:

(a) an expenditure of a selected range of hydraulic horsepower across the one or more nozzles, (b) a selected range of drilling fluid velocities exiting the one or more nozzles, and (c) a selected range of solid material impactor velocities exiting the one or more nozzles.

17. The method of drilling a subterranean formation as defined in claim 14, further comprising:

determining at least one or more drilling parameters from a group consisting of (a) a number of teeth on the drilling bit that engage the formation per unit of time, (b) a rate of drilling bit penetration into the formation, (c) a depth of drilling bit penetration into the formation from a depth reference point, (d) a formation drillability factor, (e) a number of solid material impactors introduced into the drilling fluid per unit of time, (f) at least one of an axial force and a rotational force applied to the drilling bit, (g) the selected circulation rate, and (h) the selected pump pressure.

18. The method of drilling a subterranean formation as defined in claim 14, further comprising:

monitoring one or more drilling parameters; and altering at least one of the monitored one or more drilling parameters and another drilling parameter as a function of the monitored one or more drilling parameters.

19. The method of drilling a subterranean formation as defined in claim 18, wherein monitoring one or more drilling parameters includes monitoring one or more drilling parameters from a group of drilling parameters consisting of (a) a rate of drilling bit rotation, (b) a rate of drilling bit penetration into the formation, (c) a depth of drilling bit penetration into the formation from a depth reference point, (d) a formation drillability factor, (e) a number of solid material impactors introduced into the drilling fluid per unit of time, (f) at least one of an axial force and a rotational force applied to the drilling bit, (g) the selected circulation rate, and (h) the selected pump pressure.

20. The method of drilling a subterranean formation as defined in claim 14, wherein the velocity of the drilling fluid while exiting the drilling bit causes a substantial portion by weight of the plurality of solid material impactors to create a structurally altered zone in the formation having a structurally altered zone height in a direction perpendicular to a plane of impaction at least two times a mean particle diameter of particles in the formation impacted by the plurality of solid material impactors.

21. The method of drilling a subterranean formation as defined in claim 14, wherein the structurally altered zone includes one of fractures propagated into the formation and a compressive spike in the formation.

22. The method of drilling a subterranean formation as defined in claim 21, further comprising:

engaging at least one of the propagated fractures and an impactor altered zone of the formation in the vicinity of the propagated fracture with a tooth on the drilling bit.

23. The method of drilling a subterranean formation as defined in claim 14, wherein the velocity of the impactors exiting the drilling bit causes a substantial portion by weight of the impactors to engage the formation and alter the structural properties of the formation to a depth of at least two times the mean diameter of particles in the impacted formation, thereby creating an impactor altered zone.

24. The method of drilling a subterranean formation as defined in claim 14, wherein the velocity of the plurality of solid material impactors exiting the drilling bit creates a plurality of craters in the formation each having a crater depth of at least one-third the diameter of a respective impactor.

25. The method of drilling a subterranean formation as defined in claim 14, further comprising:

altering a feed rate of the plurality of solid material impactors into the drilling fluid in response to a monitored drilling parameter.

26. The method of drilling a subterranean well as defined in claim 14, further comprising:

forming a dual-discharge nozzle within the drill bit for generating each of (1) a radially outer drilling fluid jet substantially encircling a jet axis, and (2) an axial drilling fluid jet substantially aligned with and coaxial with the jet axis; and directing a majority by weight of the plurality of solid material impactors into the axial drilling fluid jet.

27. The method of drilling a subterranean formation as defined in claim 14, wherein each of the introduced plurality of solid material impactors is substantially spherical.

28. The method of drilling a subterranean formation as defined in claim 27, wherein a majority by weight of the introduced plurality of solid material impactors each have a diameter of at least 0.100 inches.

29. The method of drilling a subterranean formation as defined in claim 28, further comprising:

monitoring one or more drilling/formation parameters; and selecting a diameter range of the plurality of solid material impactors as a function of at least one of the one or more monitored drilling/formation parameters.

30. The method of drilling a subterranean formation as defined in claim 14, wherein the introduced plurality of solid material impactors are substantially crystalline shaped.

31. The method of drilling a subterranean formation as defined in claim 14, wherein the at least one nozzle includes a plurality of nozzles and a majority by weight of the impactors are passing through the plurality of nozzles.

32. The method of drilling a subterranean formation as defined in claim 14, wherein at least one of the at least one nozzles separates a first portion of the drilling fluid flowing through the impactor nozzle into a first drilling fluid stream having a first drilling fluid exit nozzle velocity, and a second portion of the drilling fluid flowing through the impactor nozzle into a second drilling fluid stream having a second drilling fluid exit nozzle velocity lower than the first drilling fluid exit nozzle velocity.

33. The method of drilling a subterranean formation as defined in claim 32, further comprising:

directing the plurality of solid material impactors into the first drilling fluid stream such that a velocity of the plurality of solid material impactors while exiting the drill bit is substantially greater than a velocity of the drilling fluid while passing through a nominal diameter flow path in the bit end of the drill string to accelerate the plurality of solid material impactors.

34. The method of drilling a subterranean formation as defined in claim 14, wherein the velocity of a majority by weight of the plurality of solid material impactors exiting the drilling bit is a least 200 feet per second.

35. The method of drilling a subterranean formation as defined in claim 14, wherein introducing the plurality of solid material impactors into the drilling fluid further comprises:

monitoring one or more drilling parameters; and adjusting a rate of solid material impactor introduction into the drilling fluid in response to the monitored one or more drilling parameters.

36. A method of drilling a subterranean well through a subterranean formation using a drilling rig, a drill string, a fluid pump located substantially at the drilling rig and a drilling fluid, the drill string including an upper end located substantially near the drilling rig and a bit end including a drill bit supported thereon, the method comprising:

providing the drill bit with at least one nozzle such that a velocity of the drilling fluid while exiting the drill bit is substantially greater than a velocity of the drilling fluid while passing through a nominal diameter flow path in the bit end of the drill string;

providing a plurality of solid material impactors substantially adjacent the drilling rig;

introducing the plurality of solid material impactors into the drilling fluid to circulate the plurality of solid material impactors with the drilling fluid through the drill string and through the drill bit, the drilling fluid being pumped at at least one of a selected circulation rate and a selected pump pressure, a majority by weight of the plurality of solid material impactors, a majority by weight of the plurality of solid material impactors having a mean diameter in excess of 0.100 inches;

rotating the drill bit while engaging the formation to generate formation cuttings; and circulating at least some of the drilling fluid, the plurality of solid material impactors and the formation cuttings from the at least one nozzle.

37. The method of drilling a subterranean well as defined in claim 36, further comprising:

substantially separating each of the formation cuttings and the plurality of solid material impactors from the drilling fluid at the surface of the well to salvage the drilling fluid for recirculating the drilling fluid into at least one of the well and another well.

38. The method of drilling a subterranean well as defined in claim 36, further comprising:

substantially separating the plurality of solid material impactors from the cuttings for discarding the cuttings and for salvaging at least a portion of the plurality of solid material impactors for recirculating the at least a portion of the plurality of solid material impactors into the wellbore.

39. The method of drilling a subterranean well as defined in claim 36, wherein the velocity of the plurality of solid material impactors exiting the drill bit causes a majority by weight of the plurality of solid material impactors to engage the formation and propagate a substantial portion by weight of the plurality of solid material impactors engaging the formation into the formation a depth of at least one-third a diameter of a respective impactor, such that a tooth on the drill bit engages one of a portion of a respective propagated impactor and a portion of an impactor altered zone of the formation in the vicinity of the propagated impactor.

40. The method of drilling a subterranean well as defined in claim 39, wherein the velocity of the drilling fluid and the plurality of solid material impactors exiting the drill bit causes a majority by weight of the plurality of solid material impactors to engage the formation and propagate a substantial portion of the plurality of solid material impactors engaging the formation into the formation a depth of at least the diameter of a respective impactor, thereby creating a propagation path in the formation and an impactor altered zone in the vicinity of the propagation path; and engaging at least one of the propagation path and the structurally altered zone in the vicinity of the propagation path with a tooth on the drill bit to extract formation cuttings.

41. The method of drilling a subterranean well as defined in claim 36, further comprising:

providing an impactor introduction port upstream of a swivel quill located substantially near the upper end of the drill string; and introducing the plurality of solid material impactors comprises introducing the plurality of solid material impactors through the impactor introduction port into the drilling fluid.

42. The method of drilling a subterranean well as defined in claim 36, further comprising:

forming a dual-discharge nozzle within the drill bit for generating each of (1) a radially outer drilling fluid jet substantially encircling a jet axis, and (2) an axial drilling fluid jet substantially aligned with and coaxial with the jet axis, and the dual discharge nozzle directing a majority by weight of the plurality of solid material impactors into the axial drilling fluid jet.

43. The method of drilling a subterranean well as defined in claim 36, wherein the injected plurality of solid material impactors are substantially spherical and a majority by weight of the plurality of solid material impactors are of a substantially uniform mean diameter.

44. The method of drilling a subterranean well as defined in claim 36, wherein the introduced plurality of solid material impactors are substantially crystalline.

45. The method of drilling a subterranean well as defined in claim 36, wherein the introduced plurality of solid material impactors are substantially rounded and majority by weight of the plurality of solid material impactors have a substantially non-uniform mean diameter.

46. The method of drilling a subterranean well as defined in claim 36, wherein at least a majority by weight of the introduced plurality of solid material impactors have a mean diameter of at least 0.125 inches and as large as 0.333 inches.

47. The method of drilling a subterranean well as defined in claim 36, wherein at least a majority by weight of the introduced plurality of solid material impactors have a mean diameter of at least 0.150 inches and as large as 0.250 inches.

48. The method of drilling a subterranean well as defined in claim 36, wherein a majority by weight of the plurality of solid material impactors are substantially crystalline shaped.

49. The method of drilling a subterranean well as defined in claim 36, wherein at least a majority by weight of the introduced plurality of solid material impactors are of a non-uniform shape having at least one length dimension of at least 0.100 inches.

50. The method of drilling a subterranean well as defined in claim 36, wherein at least one of the at least one nozzles is an impactor nozzle to accelerate the velocity of the plurality of solid material impactors through the one or more impactor nozzles as compared to the velocity of the plurality of solid material impactors through a nominal diameter flow path in a lower portion of the drill string.

51. The method of drilling a subterranean well as defined in claim 36, wherein at least one of the at least one nozzles separates a first portion of the drilling fluid flowing through the impactor nozzle into a first drilling fluid stream having a first drilling fluid exit nozzle velocity, and a second portion of the drilling fluid flowing through the impactor nozzle into a second drilling fluid stream having a second drilling fluid exit nozzle velocity lower than the first drilling fluid exit nozzle velocity.

52. The method of drilling a subterranean well as defined in claim 51, the method further comprising:

directing the plurality of solid material impactors into the first drilling fluid stream such that a velocity of the plurality of solid material impactors while exiting the drill bit is substantially greater than a velocity of the drilling fluid while passing through a nominal diameter flow path in the bit end of the drill string accelerate the plurality of solid material impactors.

53. The method of drilling a subterranean well as defined in claim 36, wherein the velocity of a majority by weight of the plurality of solid material impactors immediately exiting the drill bit is at least 200 feet per second.

54. The method of drilling a subterranean well as defined in claim 36, wherein the velocity of a majority by weight of the plurality of solid material impactors immediately exiting the drill bit is at least 200 feet per second and as great as 1200 feet per second.

55. The method of drilling a subterranean well as defined in claim 36, wherein the velocity of a majority by weight of the plurality of solid material impactors immediately exiting the drill bit is at least 200 feet per second and as great as 750 feet per second.

56. The method of drilling a subterranean well as defined in claim 36, wherein the velocity of a majority by weight of the plurality of solid material impactors immediately exiting the drill bit is at least 350 feet per second and as great as 500 feet per second.

57. The method of drilling a subterranean well as defined in claim 36, wherein introducing the plurality of solid material impactors into the drilling fluid further comprises:

hydraulically isolating an auger type impactor introduction device from the circulating drilling fluid;

filling the auger type impactor introduction device at a low pressure from a fill end with a plurality of solid material impactors;

sealing the impactor introduction device to internally withstand at least the selected pump pressure;

hydraulically communicating a discharge end of the impactor introduction device with the drilling fluid at the selected pump pressure; and displacing solid material impactors from within the impactor introduction device into the drilling fluid by rotating an impactor auger within an impactor introducer housing.

58. The method of drilling a subterranean well as defined in claim 36, wherein introducing the plurality of solid material impactors into the drilling fluid further comprises:

introducing at least 1000 solid material impactors per minute into the drilling fluid.

59. The method of drilling a subterranean well as defined in claim 36, wherein introducing the plurality of solid material impactors into the drilling fluid further comprises:

adjusting the rate of introducing plurality of solid material impactors into the drilling fluid in response to the total number of times teeth on the bit will impact the formation per unit of time.

60. A method of drilling a subterranean formation using a drilling rig, a drill string, a fluid pump substantially at the drilling rig and a drilling fluid, the drill string including a feed end located substantially near the drilling rig and a bit end including a drilling bit supported thereon, the method comprising:

providing the drilling bit to include at least one nozzle such that a velocity of the drilling fluid while exiting the drilling bit is substantially greater than a velocity of the drilling fluid while passing through a nominal diameter flow path in the bit end of the drill string;

providing a plurality of solid material impactors substantially adjacent the drilling rig;

introducing the plurality of solid material impactors into the drilling fluid to circulate the plurality of solid material impactors with the drilling fluid at at least one of a selected circulation rate and a selected pump pressure through the drilling bit, a substantial portion by weight of the plurality of solid material impactors creating a structurally altered zone in the formation having a structurally altered zone height in a direction perpendicular to a plane of impaction at least two times a mean particle diameter of particles in the formation impacted by the plurality of solid material impactors;

rotating the drilling bit while engaging the formation to generate formation cuttings; and circulating at least some of the drilling fluid, the plurality of solid material impactors and the formation cuttings away from the at least one nozzle.

61. The method of drilling a subterranean formation as defined in claim 60, wherein a majority by weight of the plurality of solid material impactors have an impactor diameter of at least 0.100 inches.

62. The method of drilling a subterranean formation as defined in claim 60, wherein the structurally altered zone includes a fracture in the formation having a fracture height at least two times a mean particle diameter of particles in the impacted formation.

63. The method of drilling a subterranean formation as defined in claim 60, wherein introducing the plurality of solid material impactors into the drilling fluid creates at least one fracture in the formation having a fracture height at least eight times a mean particle diameter of particles in the impacted formation.

64. The method of drilling a subterranean formation as defined in claim 60, wherein introducing the plurality of solid material impactors into the drilling fluid creates at least one fracture in the formation having a fracture height at least two times a mean diameter of a majority by weight of the plurality of solid material impactors impacting the formation.

65. The method of drilling a subterranean formation as defined in claim 60, wherein the structurally altered zone includes a compressive spike in the formation having a spike length at least two times a mean particle diameter of particles in the formation.

66. The method of drilling a subterranean formation as defined in claim 60, wherein the plurality of solid material impactors are introduced into the drilling fluid after the drilling fluid has been circulated through the fluid pump.

67. The method of drilling a subterranean formation as defined in claim 60, further comprising:

selecting at least one of the selected circulation rate and the selected pump pressure such that the momentum of at least five percent by weight of the plurality of solid material impactors at a point of impact with the formation creates a plurality of fractures in the formation each having a fracture length at least two times a mean particle diameter of particles in the impacted formation.

68. The method of drilling a subterranean formation as defined in claim 60, wherein introducing the plurality of solid material impactors into the drilling fluid creates a structurally altered zone in the formation having a structurally altered zone height in a direction perpendicular to a plane of impaction at least four times a mean particle diameter of particles in the impacted formation.

69. The method of drilling a subterranean formation as defined in claim 60, wherein introducing the plurality of solid material impactors into the drilling fluid creates a structurally altered zone in the formation having a structurally altered zone height in a direction perpendicular to a plane of impaction at least eight times a mean particle diameter of particles in the impacted formation.

70. The method of drilling a subterranean formation as defined in claim 60, wherein introducing the plurality of solid material impactors into the drilling fluid creates a structurally altered zone in the formation having a structurally altered zone height in a direction perpendicular to a plane of impaction at least two times a mean diameter of a majority by weight of the plurality of solid material impactors impacting the impacted formation.

71. The method of drilling a subterranean formation as defined in claim 60, further comprising:

adjusting the rate of introducing the plurality of solid material impactors into the drilling fluid.

72. The method of drilling a subterranean formation as defined in claim 60, wherein introducing the plurality of solid material impactors into the drilling fluid causes a majority by weight of the introduced impactors to engage the formation and cause a substantial portion of the majority by weight of the impactors engaging the formation to alter one or more structural rock properties of the formation in the vicinity of a respective point of impact.

73. The method of drilling a subterranean formation as defined in claim 72, wherein altering one or more structural rock properties includes creating a fracture in the formation in the vicinity of a respective point of impact.

74. The method of drilling a subterranean formation as defined in claim 72, wherein altering one or more structural rock properties includes creating a micro-fractured zone in the vicinity of a respective point of impact.

75. The method of drilling a subterranean formation as defined in claim 60, wherein introducing the plurality of solid material impactors into the drilling fluid causes a first impactor to engage the formation, and subsequently causes at least one additional impactor to engage the first impactor thereby causing at least one of the first impactor and the at least one additional impactor to alter the structural rock properties in the vicinity of at least one of the first impactor and the at least one additional impactor.

76. The method of drilling a subterranean formation as defined in claim 60, wherein rotating the drilling bit causes at least one tooth on the drilling bit to engage at least one solid material impactor causing the at least one solid material impactor to alter the structural rock properties of the formation.

77. A system for drilling a subterranean formation using a drilling rig, a drilling fluid pumped into a well bore by a fluid pump located at the drilling rig, a drill string including a feed end located substantially near the drilling rig, a bit end for supporting a drill bit, and including at least one through bore to conduct the drilling fluid between the drilling rig and the drill bit, the drill bit including at least one nozzle at least partially housed in the drill bit such that a velocity of the drilling fluid while passing through a nominal diameter of the through bore in the bit end of the drill string, the system comprising:

an impactor introducer to introduce a plurality of solid material impactors into the drilling fluid and into the feed end of the drill string before circulating the plurality of impactors and the drilling fluid to the drill bit;

the plurality of solid material impactors passing with the drilling fluid through the at least one nozzle in the drill bit such that the velocity of the impactors while exiting the at least one nozzle is substantially greater than a velocity of the drilling fluid while passing through the nominal diameter of the through bore in the bit end of the drill string, such that at least some of the plurality of impactors are circulated substantially back to the drilling rig with the drilling fluid, and wherein a majority by weight of the plurality of solid material impactors have an impactor diameter in excess of 0.100 inches.

78. The system for drilling a subterranean formation as defined in claim 77, further comprising:

an impactor introducer conduit for conducting the plurality of solid material impactors from the impactor introducer substantially to the feed end of the drill string.

79. The system for drilling a subterranean formation as defined in claim 77, further comprising:

a fluid conduit for conducting the drilling fluid from the drilling fluid pump substantially to the feed end of the drill string, the fluid conduit having an introduction port for introducing the plurality of solid impactors from the impactor introducer into the drilling fluid.

80. The system for drilling a subterranean formation as defined in claim 79, further comprising:

a gooseneck having a through bore for conducting drilling fluid from the fluid conduit to a drilling swivel, and the gooseneck including the introduction port in the gooseneck; and a drilling swivel including a through bore for conducting drilling fluid therein, substantially supported on the feed end of the drill string for conducting drilling fluid from the goose neck into the feed end of the drill string.

81. The system for drilling a subterranean formation as defined in claim 77, further comprising:

a drilling fluid separator located at the surface to substantially separate at least one of the cuttings and the plurality of solid material impactors from the drilling fluid at the surface of the well to salvage the drilling fluid for recirculating the drilling fluid into one of the well and another well.

82. The system for drilling a subterranean formation as defined in claim 77, further comprising:

an impactor separator located at the surface to substantially separate the plurality of solid material impactors from the cuttings.

83. The system for drilling a subterranean formation as defined in claim 77, wherein the plurality of solid material impactors are substantially spherical.

84. The system for drilling a subterranean formation as defined in claim 83, wherein a majority by weight of the plurality of solid material impactors have a diameter of at least 0.125 inches and as great as 0.333 inches.

85. The system for drilling a subterranean formation as defined in claim 83, wherein a majority by weight of the plurality of solid material impactors have a diameter of at least 0.150 inches and as great as 0.250 inches.

86. The system for drilling a subterranean formation as defined in claim 77, wherein a majority by weight of the plurality of solid material impactors have a velocity of at least 200 feet per second at engagement with the formation.

87. The system for drilling a subterranean formation as defined in claim 77, wherein a majority by weight of the plurality of solid material impactors have a velocity of at least 200 feet per second and as large as 1200 feet per second at engagement with the formation.

88. The system for drilling a subterranean formation as defined in claim 77, wherein a majority by weight of the plurality of solid material impactors have a velocity of at least 200 feet per second and as large as 750 feet per second at engagement with the formation.

89. The system for drilling a subterranean formation as defined in claim 77, wherein a majority by weight of the plurality of solid material impactors have a velocity of at least 350 feet per second and as large as 500 feet per second at engagement with the formation.

90. The system for drilling a subterranean formation as defined in claim 77, wherein the solid material impactors are substantially metallic.

91. The system for drilling a subterranean formation as defined in claim 77, wherein the at least one nozzle in the drill bit comprises a dual jet nozzle for separating a first portion of the drilling fluid flowing through the dual jet nozzle into a first drilling fluid stream having a first drilling fluid exit nozzle velocity, and a second portion of the drilling fluid flowing through the dual jet nozzle into a second drilling fluid stream having a second drilling fluid exit nozzle velocity lower than the first drilling fluid exit nozzle velocity.

92. The system for drilling a subterranean formation as defined in claim 91, wherein the at least one dual jet nozzle includes an impactor director portion for directing the plurality of solid material impactors into the first drilling fluid stream to increase the velocity of the plurality of solid material impactors while exiting the at least one dual jet nozzle as compared to the velocity of the plurality of solid material impactors while passing through a nominal diameter flow path in a bit end of the drill string.

93. The system for drilling a subterranean formation as defined in claim 77, further comprising:

an impactor source vessel for holding at least some of the plurality of solid material impactors before introducing the plurality of solid material impactors into the impactor introducer.

94. The system for drilling a subterranean formation as defined in claim 77, further comprising:

an impactor grader for sorting the plurality of solid material impactors prior to the plurality of solid material impactors being circulated from the well.

95. The system for drilling a subterranean formation as defined in claim 77, further comprising:

the pump pressurizing drilling fluid before introducing the plurality of solid material impactors into the drilling fluid through an impactor injection port in a drilling fluid line, the impactor injection port located between the fluid pump and the feed end of the drill string.

96. The system for drilling a subterranean formation as defined in claim 77, further comprising:

an impactor injector including an auger for introducing the plurality of solid material impactors into the drilling fluid between the fluid pump and the upper end of the drill string.

* * * * *